US006832614B2

(12) United States Patent
Frazier

(10) Patent No.: US 6,832,614 B2
(45) Date of Patent: Dec. 21, 2004

(54) HAIR EXTENSION ATTACHMENT

(76) Inventor: Carol W. Frazier, 2114 Seward Ave., Evanston, IL (US) 60202-1948

( * ) Notice: Subject to any disclaimer, the term of this patent is extended or adjusted under 35 U.S.C. 154(b) by 57 days.

(21) Appl. No.: 10/336,008

(22) Filed: Jan. 3, 2003

(65) Prior Publication Data

US 2004/0129285 A1 Jul. 8, 2004

(51) Int. Cl.[7] ..... A41G 3/00; A41G 5/00
(52) U.S. Cl. ..... 132/53; 132/201
(58) Field of Search ..... 132/201, 53, 54, 132/55, 56

(56) References Cited

U.S. PATENT DOCUMENTS

| | | | | |
|---|---|---|---|---|
| 300,938 A | * | 6/1884 | Beck | 132/53 |
| 431,837 A | * | 7/1890 | Borden | 132/53 |
| 2,621,663 A | | 12/1952 | Jenkins | |
| 2,865,380 A | | 12/1958 | Mitchell | |
| 3,280,826 A | | 10/1966 | Jenkins | |
| 3,295,534 A | | 1/1967 | Dorkin | |
| 3,812,867 A | * | 5/1974 | Wanderman et al. | 132/53 |
| 4,372,330 A | | 2/1983 | Nelson | |
| 4,830,029 A | | 5/1989 | Bird | |
| 4,966,173 A | | 10/1990 | Russell | |
| 5,072,745 A | | 12/1991 | Cheh | |
| 5,107,867 A | | 4/1992 | Barrington | |
| 5,121,761 A | | 6/1992 | Meister | |
| 5,357,986 A | | 10/1994 | Hargrett | |
| 5,551,452 A | | 9/1996 | Barlow | |
| 5,575,298 A | | 11/1996 | Hinton | |
| 5,722,434 A | * | 3/1998 | Walker | 132/53 |
| 5,740,819 A | | 4/1998 | Hicks | |
| 6,019,107 A | | 2/2000 | Overmyer et al. | |
| 6,135,122 A | | 10/2000 | Campbell et al. | |
| 6,405,736 B2 | | 6/2002 | Townsend | |
| 6,446,636 B1 | | 9/2002 | Vittallo | |
| 2001/0035192 A1 | | 11/2001 | Townsend | |

FOREIGN PATENT DOCUMENTS

| | | |
|---|---|---|
| DE | 3722108 | 1/1989 |
| EP | 876773 | 11/1998 |
| GB | 2327605 | 2/1999 |
| WO | WO 87/05783 | 10/1987 |

OTHER PUBLICATIONS

Printout from www.glamourhair.com Website, Dec. 11, 2002, Describing Various Types of Hair Extension Attachment Means and Other Information.
Printout from www.hisandher.com Website, Dec. 11, 2002, Describing Various Methods of Forming Wefted Hair Extensions.

* cited by examiner

*Primary Examiner*—John J. Wilson
*Assistant Examiner*—Robyn Doan
(74) *Attorney, Agent, or Firm*—Richard C. Litman

(57) ABSTRACT

Various embodiments of wefted hair extension attachments include attachment strands extending from the weft edge of the attachment. These attachment strands are braided or intertwined directly into the braids formed in the native hair of the wearer as those braids are being formed, without need for additional sewing and thread, adhesives, or other attachment apparatus. Use of the present hair extensions saves considerable time for both the person who is installing the hair extensions on the wearer, as well as for the wearer. This is due to the combining of the braiding of the wearer's native hair into an attachment braid or braids, and the securing of the hair extension(s) to the braid(s), in a single step, rather than requiring the braids to be formed and then attaching the hair extensions in a subsequent step, as is accomplished conventionally.

20 Claims, 14 Drawing Sheets

HAIR EXTENSION ATTACHMENT

BACKGROUND OF THE INVENTION

1. Field of the Invention

The present invention relates generally to devices and methods for adding supplemental hair to the natural or native hair of a wearer, and more specifically to a series of embodiments of a wefted hair extension, each having a series of attachment strands extending therefrom. The attachment strands of the wefted extensions are braided integrally into the wearer's hair to secure the extension to the natural hair of the wearer.

2. Description of the Related Art

The addition of natural or artificial hair to the native hair of a person, is a technique which has been known for a very long time. Wigs and toupees of natural or artificial hair have been manufactured and used for centuries for various reasons, e.g., to enhance the appearance of the wearer, to cover flaws or imperfections in the natural or native hair of the wearer, to indicate profession, rank, or social status, etc. Most such additions to the natural hair of the wearer result in an artificial appearance, or at least are unsatisfactory in some manner. More recently, the application of relatively smaller hairpieces and extensions has been developed. Such smaller hair extensions are often more satisfactory for the wearer, as they can be more permanently attached to the scalp or native hair of the wearer, and in many cases can be treated and cared for in the same manner as the natural or native hair of the wearer of the hair extension.

A number of different types of hair extensions and application or attachment techniques have been developed over the years, but the basic types of hair extensions may be broadly divided into two categories, i.e., loose hair strands which are not attached to one another, and wefted hair extensions in which the hair strands are bound or wefted together along a common line or edge, with the hair extending from this weft or binding. These two different types of hair extensions may be further divided by their method of attachment to the native hair of the wearer. A large number of different attachment or application principles or techniques have been developed over the years, ranging from mechanical attachment (clamps, clips, etc.) to adhesives (chemical or heat setting, etc.) to braiding, weaving, sewing, tying, and/or knotting the hair extension into the hair of the wearer.

Each of the above types of hair extensions and methods of attachment to the head or hair of the wearer, have various disadvantages. In the case of loose, unwefted hair, the attachment process is extremely tedious and time consuming, and is thus relatively costly to perform. The result can be a beautiful and natural appearing hairdo if the hairdresser is talented, with the supplemental hair extension capable of being treated as natural hair and remaining in place for days or perhaps weeks.

The manufacture of bound or wefted hair was developed to facilitate the application of hair extensions to the head of the wearer, with the bound hair greatly shortening the time required for such an operation or application. However, the various means of attaching such wefts to the hair or scalp of the wearer all leave something to be desired. In the case of adhesives, the chemicals and/or heat applied to bond the adhesive can be injurious to the scalp and/or native hair of the wearer. Mechanical attachments, e.g., small clips and clamps, etc., tend to interfere with hair care, as they can loosen during combing, brushing, or normal hair care procedures and fall from the hair unexpectedly. Where wefted hair extensions are sewn into the native hair braids of the wearer, the process is quite time consuming and requires professional care in removal of the hair extension at a later date, when removal is desired.

The present invention responds to these various deficiencies in the prior art by providing various embodiments of wefted hair extensions, each of which includes a series of spaced apart attachment strands extending from the weft or binding thereof. In one embodiment, the strands extend opposite the natural direction of the hair from the weft, i.e., to the opposite side of the weft from the hair attached thereto. This embodiment is used primarily over the central portions of the area to be covered. Another embodiment secures the attachment strands so that their natural lie is in the same direction as the hair, i.e., attachment strands and hair extend to the same side of the weft. This embodiment is used primarily along the hairline of the scalp and/or along parts where the hair is combed back over the weft and its attachment to the underlying braid to conceal the weft and further conceal the braid. In each case, the attachment strands are braided integrally into the flat, low lying braids which are formed adjacent the wearer's scalp, thus precluding any requirement for additional materials such as needle and thread to sew the weft binding to the underlying braids, or glue, adhesive, and/or mechanical attachment means (rings, clips, clamps, etc.) for attaching the hair wefts to the native hair of the wearer. The present invention also facilitates the removal of the wefted hair from the scalp, as one need only release the secured end of the braid to allow the braid to become unbraided, thereby releasing the hair weft attachment strands from the braid as well.

A discussion of the related art of which the present inventor is aware, and its differences and distinctions from the present invention, is provided below.

U.S. Pat. No. 2,621,663, issued on Dec. 16, 1952 to Christina M. Jenkins, titled "Permanently Attaching Commercial Hair To Live Hair," describes a method of attaching loose, unwefted hair to the native hair of the wearer, using a series of strands or fibers which are interwoven with the native and supplemental hair. One end of each strand is attached to a support stand, with the opposite ends of the strands being woven into the wearer's hair. The Jenkins method is not used with wefted hair, nor is there any disclosure of any provision of single or multiple laminations of hair wefts with attachment strands extending therefrom, as in the case of the present invention. The Jenkins method is extremely time consuming and tedious, as a relatively small number of supplemental hairs must be interwoven with the three strands of native hair, with the operation being repeated innumerable times to complete the operation. Moreover, the Jenkins method requires the wearer to use a professional to remove the supplemental hair, as the attachment strands must be cut, and the wearer cannot safely cut the attachment strands herself without the near certainty that at least some of her native hair will also be cut. There is no such risk using the present hair wefts and methods of attachment, as the braided attachment need only be unraveled to release the hair wefts therefrom.

U.S. Pat. No. 2,865,380, issued on Dec. 23, 1958 to Princess Mitchell, titled "Hairpieces And Method Of Hair Preparation," describes a two step process wherein a series of French plaits (French braids) are formed transversely about the sides, back, and upper portion of the wearer's scalp, to lie closely adjacent to the scalp in the manner of cornrow type braids. After the braids or plaits are formed, a corresponding series of wefted hair extensions are sewn thereto. This process can take up to twice as long as the present method (attaching hair wefts to native hair by braiding the weft attachment strands into the braids simultaneously with braid formation), as the Mitchell method requires that the braids or plaits be completed first, and then that the extensions be sewn in place along the braids in a separate, subsequent operation. Moreover, the Mitchell method cannot be readily reversed by the wearer, due to the difficulty in cutting the attachment threads without cutting the native hair of the wearer. The Mitchell method is essentially that described as "weaving with braid track" in the His Or Her Hair website, noted further below.

U.S. Pat. No. 3,280,826, issued on Oct. 25, 1966 to Christina M. Jenkins, titled "Hair Piece And Method Of Making And Permanently Attaching Same," describes the use of garter-type clips for the attachment of hair wefts to the native hair of the wearer. While such clips are easily installed and removed, their bulk and mass make hair care (particularly combing and brushing) difficult, to say the least. The present system does not present such problems, as the scalp surface braid attachment leaves the rest of the hair free along its entire length.

U.S. Pat. No. 3,295,534, issued on Jan. 3, 1967 to Jess Dorkin, titled "Hair Thickening Method," describes the use of a urethane adhesive for the attachment of individual or multiple strands of hair to the scalp or native hair of the wearer. This type of supplemental hair attachment is also relatively time consuming, due to the strand by strand (or relatively few strands) securing at each step. The removal process is not appreciably quicker, due to the need to carefully remove all of the adhesive, either by chemical or other means. The chemicals can be harsh to the scalp and hair of the wearer, and both the installation and removal processes can damage the native or natural hair of the wearer.

U.S. Pat. No. 4,372,330, issued on Feb. 8, 1983 to Charles W. Nelson, titled "Method And Apparatus For Attachment Of Hair Units," describes the use of filaments of fine wire or the like, which are twisted about a relatively small number of grouped strands of native hair of the wearer, and secured using an adhesive. The strands are sewn in place using a needle, and continue from strand group to strand group to form a continuous chain. The result provides a base for the attachment of supplemental hair thereto, but Nelson does not disclose any actual supplemental hair configuration or structure in his patent. The Nelson system suffers from the same problems as noted above when supplemental hair extensions are sewn to braids or plaits, in that the hair extensions must be removed by a professional in order to minimize damage to the native hair of the wearer, and moreover, the Nelson system consumes an inordinate amount of time for both installation and removal, as the tedious twisting and gluing of the filament to the native hair of the wearer must be accomplished before the hair extensions may be attached thereto, and removed after removal of the extensions.

U.S. Pat. No. 4,830,029, issued on May 16, 1989 to Raymond F. Bird, titled "Method Of And Apparatus For Styling Hair," describes a manufactured hair weft having a pocket formed in the weft or bound edge or "tape." A wire loop is installed in the pocket, and is used to attach the hair extension to the native hair of the wearer. While the Bird method does not require the braiding or plaiting of the wearer's native hair, the specialized wire loop and pocketed weft tape are relatively bulky and massive, and result in some discomfort for the wearer when attempting to rest or sleep. The use of a wire clip or loop to secure the hair extension to the native hair, also creates some difficulty in hair care during brushing, combing, etc.

U.S. Pat. No. 4,966,173, issued on Oct. 30, 1990 to Della L. Russell, titled "Hairpiece For Compensation Of Hair Loss," describes a headband having supplemental hair disposed thereon. The Russell headband is easily installed and removed by the wearer, but is intended only to cover a relatively small patch. The Russell band cannot support a relatively large and full hair extension, with its relatively large mass, as can the present system with its positive attachment to the native hair of the wearer.

U.S. Pat. No. 5,072,745, issued on Dec. 17, 1991 to Byung J. Cheh, titled "Hair Extension Process," describes the use of hot melted adhesive to bond small groups of strands of supplemental hair extensions to the native hair of the wearer. Cheh does not disclose the use of any form of wefted hair extension with his process. The Cheh process, and the problems associated therewith, are more closely related to the process described in the Dorkin '534 U.S. patent, described further above, than they are to the present invention.

U.S. Pat. No. 5,107,867, issued on Apr. 28, 1992 to Mark C. Barrington, titled "Process For Extending Human Hair," describes the installation of a small plug to the ends of a relatively small number of strands of supplemental hair. A heat shrink sleeve is installed near the base of a relatively small number of strands of the wearer's native hair, and the plug of the supplemental hair group is placed in the heat shrink sleeve. The heat shrink sleeve is then shrunk to grip the supplemental hair plug therein. This technique results in the same problems as incurred with methods wherein the supplemental hair is glued or mechanically fastened to small tufts of the wearer's native hair, i.e., the difficulty in combing or brushing out the hair when a large number of relatively small nodules are installed therein. Also, while Barrington states that the supplemental hair plugs may be removed by reheating them, this is a job for a professional. Such a task could not be readily accomplished by the wearer of the Barrington hair supplements, by herself.

U.S. Pat. No. 5,121,761, issued on Jun. 16, 1992 to Karen L. Meister, titled "Method For Attaching Hair Extensions," describes the use of a series of small sleeves which are crimped about relatively small clumps or tufts of native hair, near the bases thereof. A wefted hair extension is then sewn through the bases of the tufts, using a needle and thread. The Meister method eliminates the need to braid the native hair of the wearer, but substitutes a series of small crimped sleeves, which must be removed professionally when the wearer wishes to remove the hair extensions. The Meister system, with the exception of its use of a wefted hair extension, more closely resembles the supplemental hair attachment method disclosed in the Barrington '867 U.S. patent, discussed immediately above, than it does the present supplemental hair attachment method.

U.S. Pat. No. 5,357,986, issued on Oct. 25, 1994 to Drucilla W. Hargrett, titled "Hair Locking Process And Apparatus," describes a braid assembly which is secured to tufts of the native hair of the wearer, rather than braiding the native hair itself. The braid attachment includes a series of small rings therein, with the weft of supplemental hair also having a like series of rings. The weft and braid rings are sewn together to secure the supplemental hair weft to the braid attachment of the wearer. This process involves a fair amount of time, as the braid material must be braided into the hair of the wearer, before the wefted hair extension can be sewn to the rings of the braid. This ring-to-ring attachment is relatively loose in comparison to the present wefted hair extension attachment, and moreover cannot be removed by the wearer, due to the need to determine the location of the attachment thread precisely in order to cut it without damaging the native hair of the wearer.

U.S. Pat. No. 5,551,452, issued on Sep. 3, 1996 to Eslie O. Barlow, titled "Hairpiece With Adjustable Support Loop," describes a loop having a series of hair tufts extending therefrom. The loop has an adjustable circumference, but is still placed relatively loosely upon the head. No means for positively attaching the loop or supplemental hair to the hair of the wearer is disclosed.

U.S. Pat. No. 5,575,298, issued on Nov. 19, 1996 to Cassandra Hinton, titled "Apparatus And Method For Concealing Attachments Of Hair Supplements," describes a relatively short and narrow adhesive tape for concealing the braid line of a conventional hair weave attachment braid, e.g., the weave attachment braid as disclosed in the Mitchell '380 U.S. patent discussed further above. The Hinton tape includes a covering of relatively short hairs on the outer surface thereof, to camouflage the underlying braid and weft attachment. The hair weft extension disclosed in the Hinton U.S. patent is conventional, i.e., it does not include any attachment strands, as provided by the hair weft extensions of the present invention.

U.S. Pat. No. 5,740,819, issued on Apr. 21, 1998 to Janice A. Hicks, titled "Process For Securing Supplemental Hair To The Natural Hair Of An Individual," describes a relatively complex process in which a wefted hair extension is bound by sewing a series of blanket stitches therein adjacent to one end thereof, with the bound portion of the weft then being sewn into a previously formed braid in the wearer's native hair. The Hicks method is quite complex in comparison to the present method, and requires considerably more time to complete. Moreover, Hicks requires professional care in the removal of hair extensions attached using her method, due to the need to carefully sever the strands of thread securing the hair extension wefts to the braids without damaging the native hair of the wearer. This is not a problem with the present hair weft extensions and method.

U.S. Pat. No. 6,019,107, issued on Feb. 1, 2000 to Tatiana L. Overmyer et al., titled "Detachable Hairpiece," describes a barrette type device having a hair extension permanently attached thereto and extending therefrom. The barrette clips to the native hair of the wearer, with the hair extension extending from the barrette to provide the appearance of longer hair for the wearer. No wefted hair extensions having attachment strands extending from the wefted ends for attachment directly to the native hair of the wearer, is provided by Overmyer et al. Moreover, the Overmyer et al. barrette extension cannot be worn for extended periods of time, as can the present wefted hair extensions.

U.S. Pat. No. 6,135,122, issued on Oct. 24, 2000 to Annie L. Campbell et al., titled "Self Adhesive Hair Weft Extension And Method Of Attaching Same," describes a wefted hair extension having a contact adhesive strip applied to the wefted or bound end of the hair extension. A release strip is removed from the adhesive, and the hair extension is adhesively attached to the native hair of the wearer for use. The adhesive principle also results in damage to the hair when the tape is removed, with at least some hair being torn, broken, and/or pulled out by the roots. Campbell et al. do not disclose a hair weft extension having attachment strands extending therefrom for intertwining into the native hair of the wearer as that hair is French braided, as is done by means of the present hair extension attachment.

U.S. Pat. No. 6,405,736, issued on Jun. 18, 2002 to Valerie Townsend, titled "Method Of Using A Self Adhesive Hair Extension," describes a hair extension and process which are very closely related to the disclosure of the Campbell et al. '122 U.S. patent discussed immediately above. Townsend differs from Campbell et al. in that Townsend sews a strip of adhesive material to the wefted end of the hair extension, and adhesively attaches her hair extension to the scalp of the wearer, rather than to the hair, as is the case with Campbell et al. Townsend does not disclose any attachment strands extending from the wefted end of the hair extension for intertwining into braids as they are formed.

U.S. Pat. No. 6,446,636, issued on Sep. 10, 2002 to Christine M. Vittallo, titled "Method Of Attaching Supplemental Hair To Human Natural Hair," describes the application of a liquid adhesive directly to the scalp or native hair of the wearer, and then adhesively securing a weft of supplemental hair to the adhesive area. This method is more closely related to the adhesive attachment methods of the Campbell et al. '122 and Townsend '736 U.S. patents, than it is to the present invention with its attachment strands extending from the weft portion of the hair extension for intertwining with a braid formed of the wearer's native hair.

U.S. Patent Publication No. 2001/35,192, published on Nov. 1, 2001, titled "Self Adhesive Hair Extension," describes a wefted hair extension and method of attachment which closely resemble those described in the '736 issued U.S. patent to the same inventor, described further above. No non-adhesive attachment means using strands of material extending from the hair weft, is disclosed by Townsend.

U.S. Patent Publication No. 2001/37,813, published on Nov. 8, 2001, titled "Attachable Hair Extension," describes the use of an adhesive strip disposed across the individual strands of a mass of hair to form a wefted hair extension. Some of the adhesive is exposed between the individual hair strands. A release sheet is removed from the adhesive, and the weft is applied to the hair or scalp of the wearer, with the exposed adhesive between the hair strands serving to secure the weft to the hair or scalp of the wearer. This hair extension and method are more closely related to the various adhesively applied hair extensions of the Campbell et al. '122 and Townsend '736 U.S. patents and the Townsend '192 U.S. patent Publication, than it is to the present hair extension attachment invention with its intertwining of the weft attachment strands with the braiding of the wearer's native hair.

PCT Patent Publication No. WO 87/5783, published on Oct. 8, 1987, titled "A Method Of And Apparatus For Styling Hair," describes the same invention as that described in the '029 U.S. patent to the same inventor, discussed further above. The points raised in that discussion are seen to apply here, as well.

German Patent Publication No. DE 3,722,108, published on Jan. 12, 1989, titled "Device For Attaching Artificial Hair To Natural Hair," describes (according to the drawings and English abstract) a small cylindrical sleeve or clamp which is secured to the native hair of the wearer, with a weft of hair having a cooperating mechanical attachment device extending therefrom. The assembly is somewhat related to that disclosed in the Barrington '867 U.S. patent, discussed further above, in which a small heat shrink sleeve is secured about a tuft of the native hair of the wearer, and a plug forming the end of a hair extension. While the '108 German Patent Publication discloses the mechanical attachment of a complete weft of hair, no disclosure is made of provision for a series of attachment strands from the weft, for interweaving with the native hair.

European Patent Publication No. 876,773, published on Nov. 11, 1998, titled "Method, Apparatus And Hair Extension Product Thereof," describes a method of forming hair weft extensions from loose locks of hair, by applying a thermoplastic resin to the ends of the hair strands to seal them together. The '773 Patent Publication is primarily directed to a tool for forming the hair wefts in the desired shape and sealing or adhesively attaching the common ends together. No means is disclosed for attaching the completed wefted hair extensions to the native hair of the wearer, as described in the present disclosure.

British Patent Publication No. 2,327,605, published on Feb. 3, 1999, titled "Scalp Patch For Hair Extension," describes a patch having hair extending from one surface for securing to the central area of the scalp of a wearer. The edge of the patch is devoid of hair, and provides a margin for sewing the patch to cornrow braids formed in the native hair of the wearer. The Arogundada '605 Patent Publication further discloses the use of a plurality of parallel cornrow braids formed in the native hair of the wearer, and stitching one or more lengths of wefted hair extensions together in a sinusoidal configuration for greater fullness. However, no disclosure is made by Arogundada of any provision for attachment strands extending from the weft or bound edge of a hair extension, for interweaving or intertwining into braids formed in the native hair of the wearer, as provided by the present invention.

In addition to the above patents and patent publications, the present inventor is aware of certain web sites which also describe wefted hair extensions and their attachment to the head or hair of the wearer. The sites www.hisandher.com and www.glamourhair.com are sites for commercial outlets which sell loose and wefted hair extensions and materials for their installation in and removal from the native hair of the wearer. Each of the above sites describes various types of wefted hair extensions and methods for braiding, adhesively bonding, weaving, or mechanically attaching such wefted hair extensions to the native hair of the wearer. However, neither of the above web sites disclose any wefted hair extensions having attachment strands extending therefrom, nor any means of intertwining such attachment strands with the native hair of the wearer as it is braided.

None of the above inventions, patents, and disclosures, taken either singly or in combination, is seen to describe the instant invention as claimed. Thus a hair extension attachment solving the aforementioned problems is desired.

SUMMARY OF THE INVENTION

The present invention comprises various embodiments of wefted hair extensions, with each of the extension embodiments including a series of attachment strands extending from the wefted or bound edge thereof. Methods of attaching the present wefted hair extensions, comprising intertwining the attachment strands integrally with the native hair of the wearer as it is braided, are also disclosed. (The term "native hair" is used generally throughout the present disclosure to describe the hair of the wearer which is rooted naturally in and growing from the scalp of the wearer of the present hair extensions. The term "native hair" is used in order to differentiate from natural hair, as the hair extensions themselves are commonly, and preferably, formed of natural human hair, although not from the native hair of the wearer.)

A first embodiment of the present hair extension comprises a wefted hair extension including a series of attachment strands extending from the weft edge, opposite the direction of the hair extending therefrom. This hair extension may comprise a single wefted row, or in a second embodiment may be sewn or otherwise combined with similar extensions to provide multiple rows of overlapping wefts, to create a fuller and more dense hair extension. The attachment strands are preferably sewn between the weft rows, where multiple wefts are secured together.

Another embodiment comprises a wefted extension similar to the extension of the first embodiment, but having the attachment strands extending from the weft edge in the same direction as the hair extending from that edge. This embodiment is used as a finishing piece, for installation along a part line or hairline as desired. Another embodiment combines a series of finishing pieces to provide two or more overlapping wefts, similar to the multiple overlapping wefts of the second embodiment described briefly above. Again, the attachment strands are preferably sewn between adjacent weft edges in the multiple weft embodiment.

Various methods of securing and removing the wefted hair extensions of the present invention to and from the native hair of the wearer, are also disclosed herein. These methods all include the common steps of providing a wefted hair extension having attachment strands extending from the wefted edge thereof, and intertwining or braiding the attachment strands integrally into a braid as the braid is formed in the native hair of the wearer. The above described method or process is considerably quicker and more efficient than other braided attachment processes known to the present inventor, as the braiding of the native hair of the wearer and the attachment of the present wefted extensions by means of their attachment strands, is accomplished in a single step. The present hair extensions are easily removed by the wearer, merely by unbraiding the braids. No delicate cutting of attachment threads, removal of adhesives or numerous small fasteners, or other operations requiring the assistance of a professional, are required for the removal of the present hair extensions.

Accordingly, it is a principal object of the invention to provide a wefted hair extension having several embodiments, each of which includes a series of flexible attachment strands extending from the weft or bound edge thereof, for intertwining integrally into a braid of native hair of the wearer of the present hair extension.

It is another object of the invention to provide such wefted hair extensions in a base piece configuration, having the attachment strands extending from the weft edge in a direction opposite the strands of hair extending therefrom, and in an alternative finishing piece wherein the attachment strands extend from the weft in the same direction as the hair strands.

It is a further object of the invention to provide both base and finishing piece hair weft extensions comprising a single wefted row or edge, and also comprising multiple, overlapping weft rows or edges to provide fuller and more dense hair in the extension.

Still another object of the invention is to provide methods of installing and removing the above described wefted hair extensions, into and from the native hair of the wearer.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a series of embodiments of a wefted hair extension, and methods of attaching and removing the hair extensions of the present invention to and from the native hair of a wearer of a hair extension. The present hair extensions provide numerous advantages over conventional hair extension attachment by hair weaving, as the present extensions include attachment strands for braiding directly into the native hair of the wearer at the time the braids are formed. This eliminates the two step process required for hair weaving, wherein a braid(s) must be formed, and then the hair extension(s) is/are attached to the braid(s) in a subsequent operation. Moreover, removal of the present hair extensions may be accomplished by the wearer by merely unbraiding the braided hair to allow the attachment strands of the hair extensions to separate from the unbraided hair. No tedious cutting of attachment threads, removal of adhesives, etc., is required with the present hair extensions.

Figure 1:
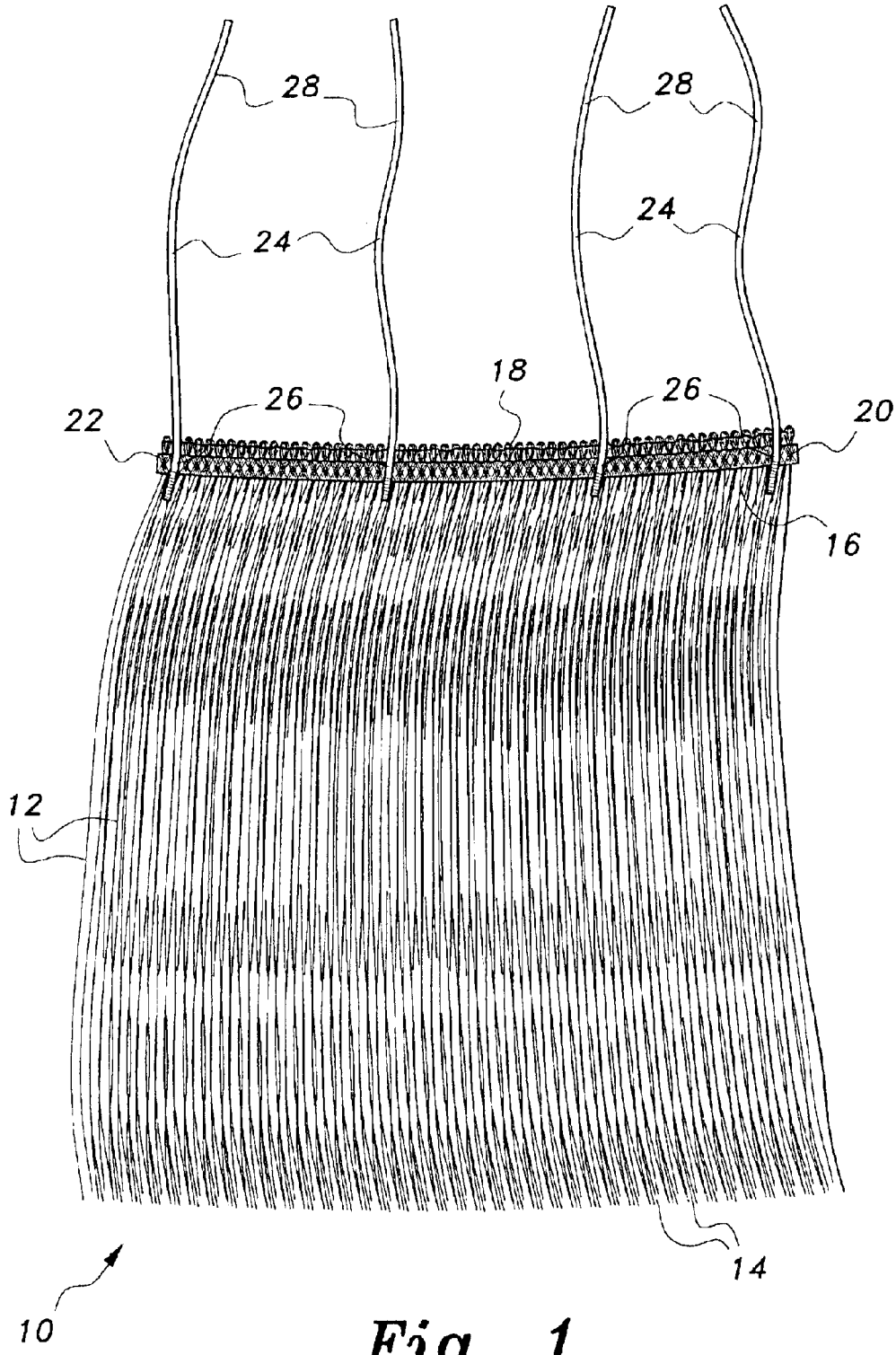
FIG. 1 is a rear elevation view of a first embodiment of a hair extension attachment according to the present invention, comprising a base piece having a single weft edge with attachment strands extending from the weft edge opposite to the direction of the hair strands.

FIG. 1 of the drawings illustrates a short section of a first embodiment of the present hair extensions, designated as hair extension 10. The hair extension 10 includes a large number of individual hair strands 12 having free ends 14 and opposite weft attachment ends 16. The weft attachment ends are bound together in a single, continuous weft edge 18, which spans the extension 10 from a first end 20 to an opposite second end 22. The hair strands 12 extend essentially unidirectionally from the bound weft edge 18, and generally form a somewhat planar sheath of hair.

While the extension 10 of FIG. 1 is illustrated as a relatively short and narrow section, it should be noted that the extension 10 and other hair extensions disclosed herein would typically include hair strands having significantly greater length, e.g., eight or more inches, and wefts having substantially greater spans, e.g., thirty six to eighty four inches. Both the weft span and hair length of such extensive hair extensions may be cut or trimmed as desired. The relatively small and short extension 10 illustrated in FIG. 1 of the drawings, as well as other extensions disclosed herein, are shown as relatively short and narrow sections for clarity in the drawing Figs. The hair strands 12 used in the construction of the present hair extensions are preferably natural human hair. Such hair may be straight, as shown, or may be curled, kinky, or have any other pattern or form as desired. Such natural hair may retain its natural color, or may be dyed or otherwise treated as desired. Alternatively, the hair strands 12 may be formed of synthetic fibers, if so desired.

Rather than being sewn into braids formed in the wearer's hair, as is conventional in hair weaving, the present hair extension 10 and other hair extensions of the present invention include a series of flexible attachment strands 24 extending therefrom. The strands 24 have attachment ends 26 sewn or otherwise permanently and securely attached to the weft edge 18 of the extension 10, and opposite free ends 28. The attachment strands 24 may be formed of any suitable flexible material, so long as the strand material is compatible with braiding integrally into the native hair of the wearer. Preferably, a fabric covered elastic material is used, but other elastic or inelastic strands, strings, cords, filaments, natural or synthetic hair, etc. may be used to form the attachment strands of any of the hair extension embodiments of the present invention. In the hair extension embodiment 10 of FIG. 1, the attachment strands 24 extend from the weft 18 generally coplanar with the plane of the hair strands 12, but in a direction opposite that of the hair strands 12, i.e., to the other side of the weft 18 from the hair strands 12. Spacing of the strands 24 is not critical, and single or multiple strands may extend from each attachment point. The extension 10 may be considered as a "base piece," configured for attachment to the wearer's native hair at any suitable area thereof.

Figure 2:
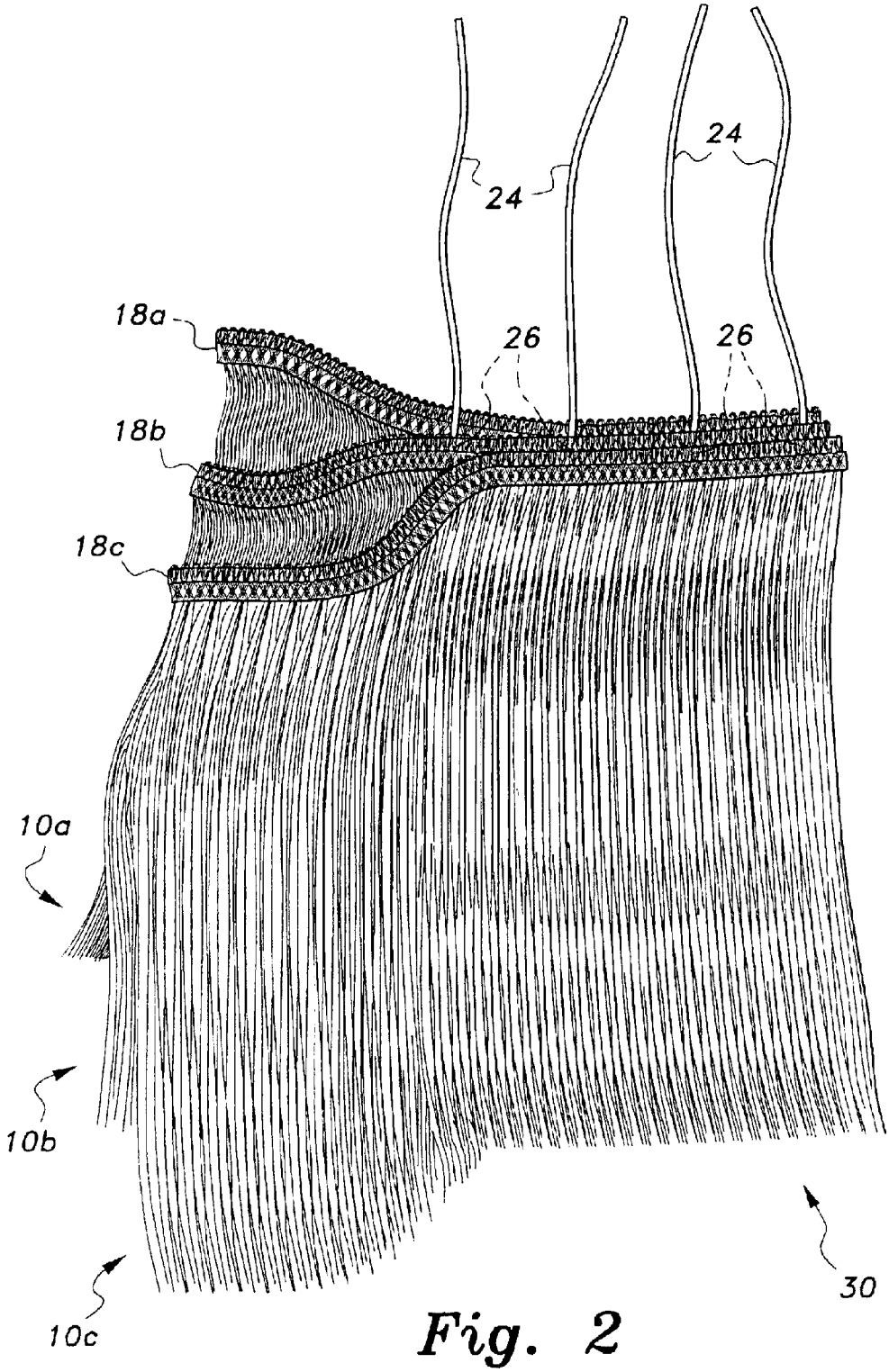
FIG. 2 is a rear elevation view of a partially constructed alternate embodiment of the wefted hair extension of FIG. 1, illustrating the overlapping assembly of a plurality of hair wefts to form a fuller and more dense hair extension.

FIG. 2 illustrates an alternative embodiment of the wefted hair extension 10 of FIG. 1, in which a plurality of such extensions are sewn or otherwise permanently secured together along their wefted edges to form a multiple weft extension 30 having a fuller and more dense fall or extension of hair. In FIG. 2, a series of wefted extensions 10*a*, 10*b*, and 10*c*, each substantially identical to the extension 10 of FIG. 1, are assembled together to form the multiple weft extension 30, by sewing or stitching their respective wefts 18*a*, 18*b*, and 18*c* together along their entire lengths. (The multiple weft extension 30 illustrated in FIG. 2 is incomplete, with the final stitching of the wefts 18*a*, 18*b*, and 18*c* shown uncompleted at the second ends thereof, in order to show clearly the three distinct wefts employed in the manufacture of the multiple weft extension 30.) The wefts 18*a*, 18*b*, and 18*c* are secured together in an overlapping configuration, with the upper edge of the weft 18*b* secured slightly below the upper edge of the weft 18*a*, and the upper edge of the weft 18*c* secured slightly below the upper edge of the weft 18*b*. The weft attachment ends 26 of the attachment strands 24 are preferably secured between the first and second wefts 18*a* and 18*b*, i.e., those wefts which are disposed closest to the scalp of the wearer when the multiple weft extension 30 is installed on the head of a wearer, and extend in a direction opposite the hair strands 12*a*, 12*b*, and 12*c*, similarly to the configuration of the single weft extension 10 of FIG. 1.

Figure 3:
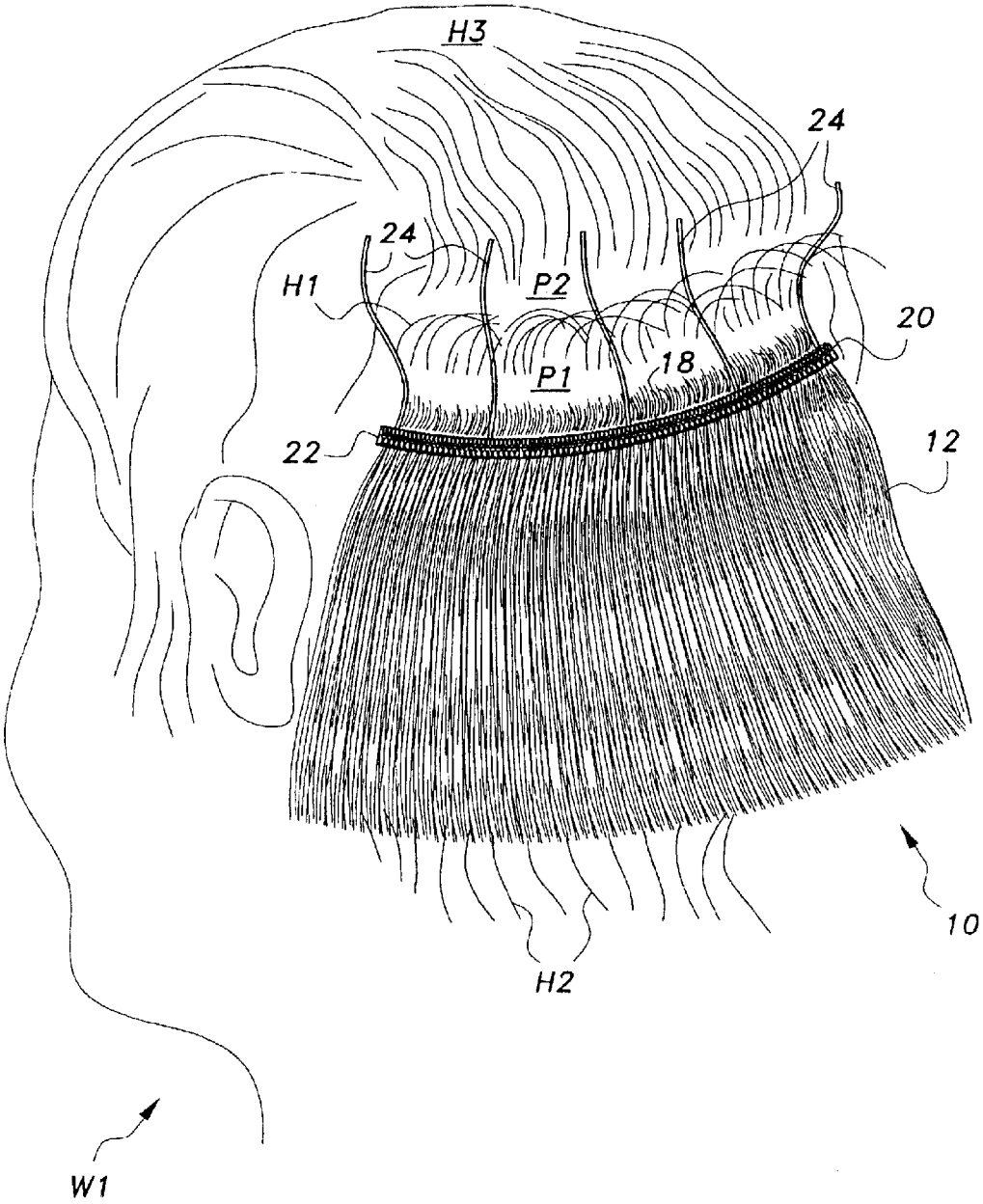
FIG. 3 is a rear perspective view of the head of a wearer of the present hair extension invention, showing a first step in the installation of a hair extension to the native hair of the wearer.

FIGS. 3 through 7 illustrate the basic procedure in the installation of the single weft extension 10 of FIG. 1, to the native hair of a wearer of the device. In FIG. 3, first and second parts P1 and P2 have been formed transversely across the back of the head of a wearer W1 of the present hair extension 10, defining a transverse line or row of braidable native hair H1 between a lower area of native hair H2 and a higher area of native hair H3 of the wearer W1. Again, it should be noted that typically the hair strands 12 of the hair extension 10 will be considerably longer than shown in FIG. 3. They are shown relatively short in the drawing Figs., for clarity in the drawings. Similarly, the width of the hair extension would be considerably greater as well, for folding back and forth through the wearer's hair for installing multiple rows of a single hair extension.

Figure 4:
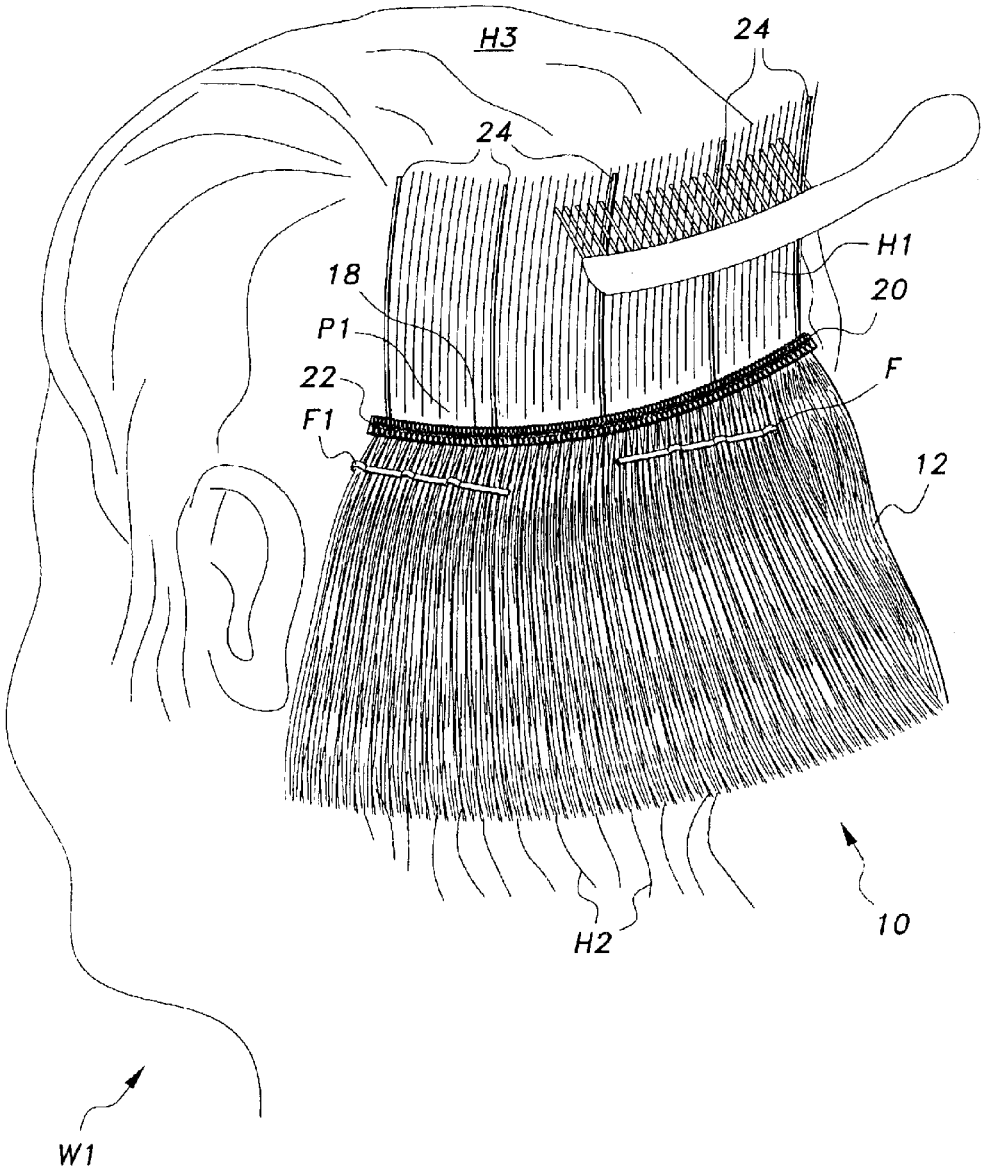
FIG. 4 is a rear perspective view of the wearer's head of FIG. 3, showing the second step in the hair extension installation of the present invention.

The wefted hair extension 10 is placed along the first part line P1, immediately adjacent the row of the wearer's native hair H1 to be braided, preferably before forming the second part line P2. The first end 20 of the weft 18 is placed at the beginning of the first part line P1, and the extension 10 is secured in its proper position covering the lower hair area H2 of the wearer, using bobby pins or other suitable temporary fasteners F, generally as shown in FIG. 4 of the drawings. The attachment strands 24 are arranged to extend upwardly, across or over the braidable hair row H1, generally as shown in FIG. 3. The attachment strands 24 are then combed into the native hair H1 between the two part lines P1 and P2, generally as shown in FIG. 4 of the drawings.

Figure 5:
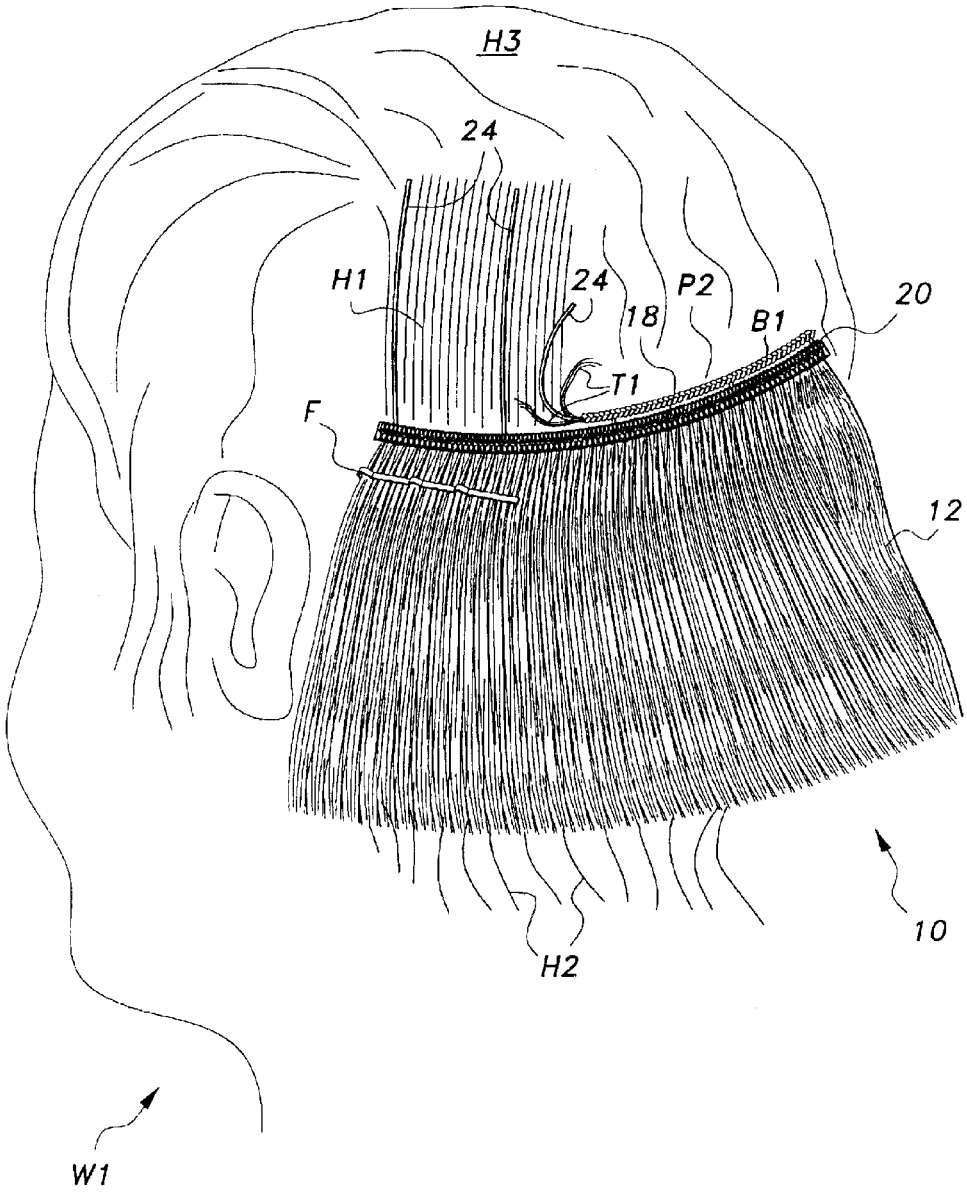
FIG. 5 is a rear perspective view of the wearer's head of FIGS. 3 and 4, showing the third step in the installation of the present hair extension.

At this point, a braiding pattern is initiated in the row of hair H1 between the two part lines P1 and P2, generally as shown in FIG. 5 of the drawings. The wefted hair extension attachment strands 24 which have been entrained in the braidable hair H1 during the combing step illustrated in FIG. 4, are braided integrally with the hair H1 during this step in the process. In FIG. 5, the braiding process has been started from the first end 20 of the hair extension 10, working from right to left across the back of the head of the wearer W1 to form the beginning of a first braid row B1. It should be noted that the initiation of the braiding sequence from the right side is not required, and that any braiding pattern may be used as desired, depending upon the orientation of the part lines P1, P2, etc. which may be formed in the hair of the wearer. The braiding is accomplished by dividing the strands of the native hair H1 between the two part lines P1 and P2 into three sections to form multiple fingers T1 of the wearer's native hair, and then braiding these fingers T1 together, along with the wefted extension attachment strands 24 as they are encountered with their entrainment in the braiding hair H1 of the wearer. A French braid may be formed, as shown, or some other type of braid may be formed as desired. The braiding is formed to lie immediately adjacent the scalp of the wearer, as is customary in the hair weaving art. The type or style of braid formed is similar to that known as "cornrow" braiding, in which a number of fine braids are formed in parallel rows to lie immediately adjacent the scalp of the wearer.

The above described method of attaching the present wefted hair extensions to the native hair of a wearer may be terminated at the completion of a single braided row, if so desired, generally as shown in FIG. 5 with its abbreviated weft span. If additional hair extensions are desired, separate lengths may be added by repeating the process illustrated in FIGS. 3 through 5 and described in detail above. However, it is anticipated that the wefted hair extension would normally be provided with a weft span considerably greater than that illustrated in FIGS. 1 through 5 of the drawings. Such wider weft spans would permit a single wefted extension to be folded back and forth over itself in multiple rows, and secured to the native hair of the wearer in a corresponding number of braid rows.

Figure 6:
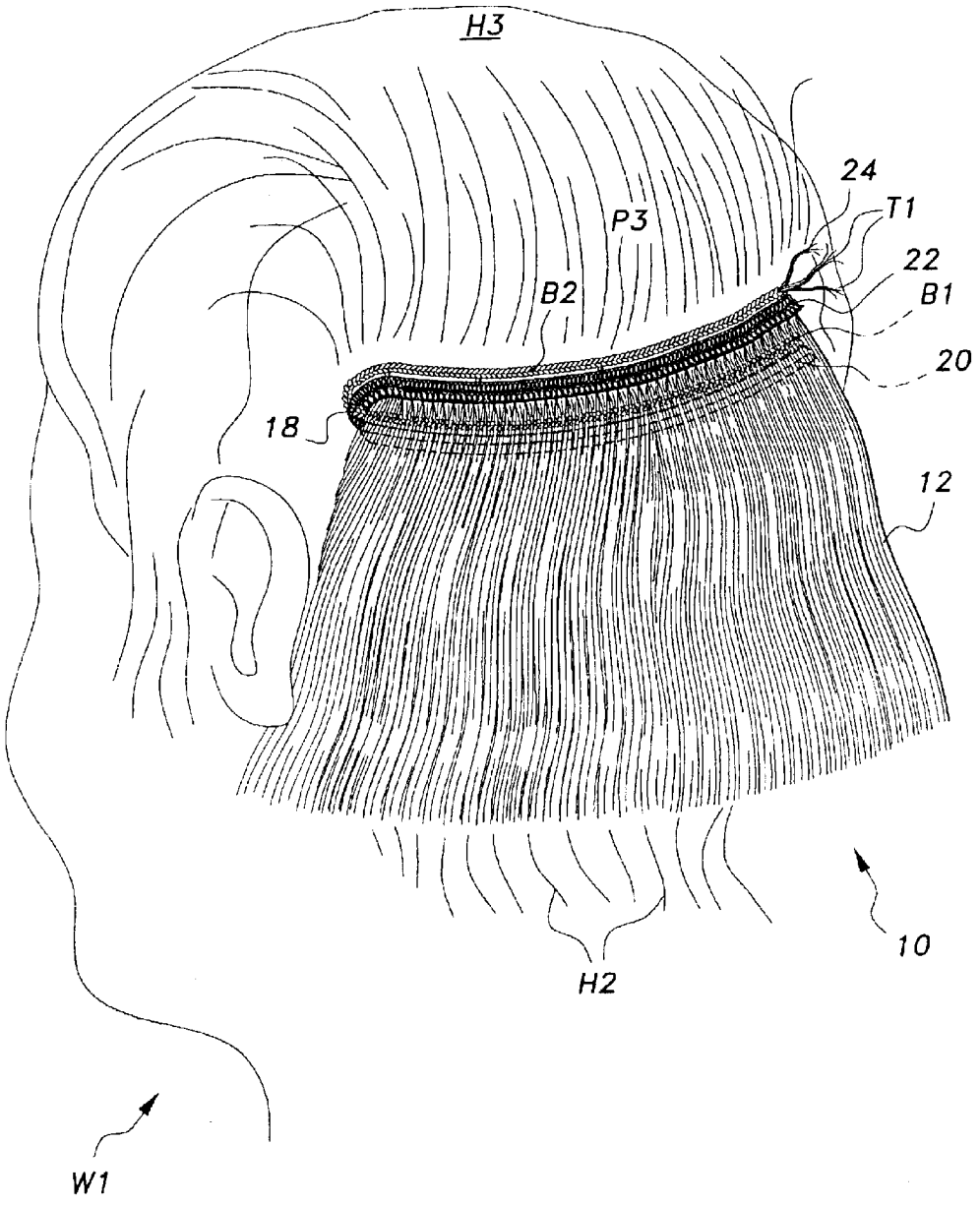
FIG. 6 is a rear perspective view of the wearer's head of FIGS. 3 through 5, showing the fourth step in the present hair extension installation.
Figure 7:
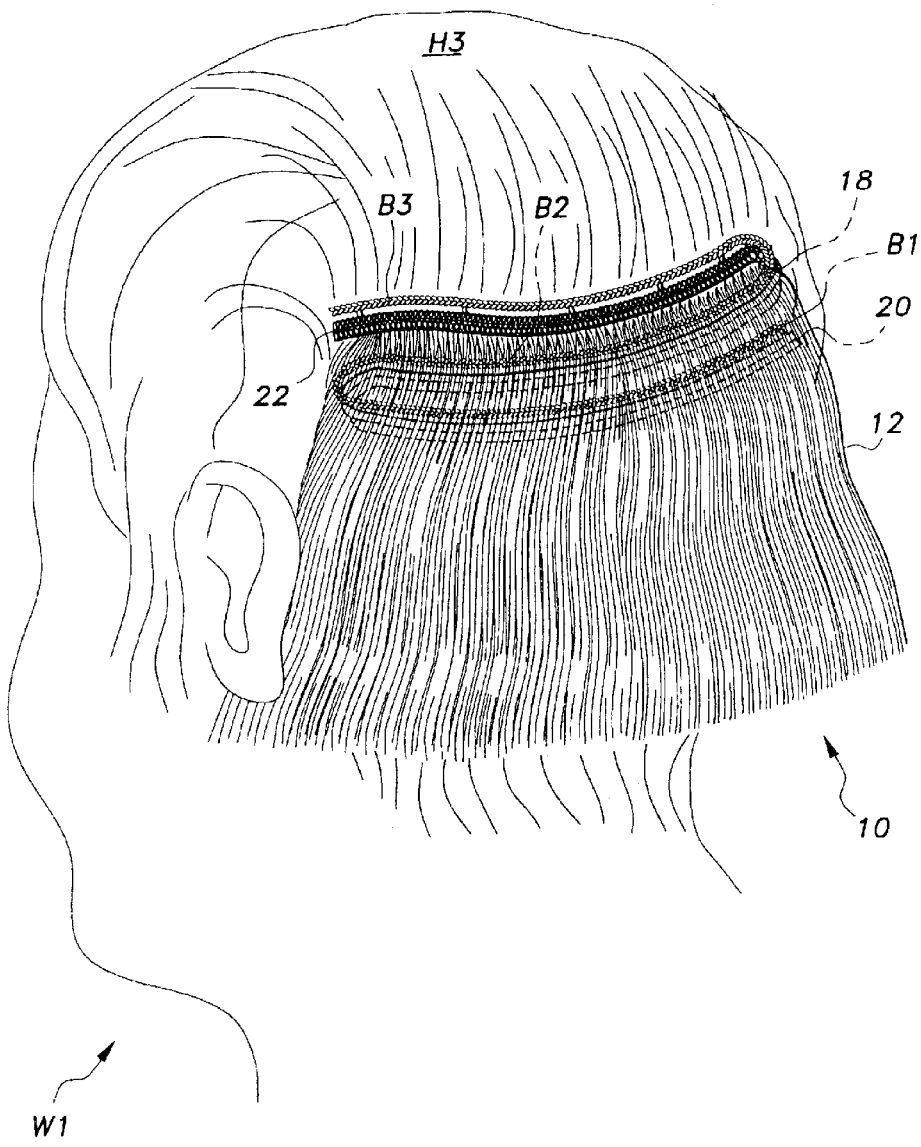
FIG. 7 is a rear perspective view of the wearer's head of FIGS. 3 through 6, illustrating the final step in the installation of the present hair extension, immediately before applying the finishing piece and/or combing the wearer's native hair over the completed hair extension installation.

FIG. 6 illustrates the formation of a second braid row B2, in which a third part line P3 is formed to define another row of braidable hair which has been braided to form the second braid row B2 in FIG. 6. When the first braid row B1 has been completed, the unfinished braid end is secured temporarily (e.g., bobby pin, etc.). The remaining weft 18 is folded over the preceding part line P2, and a new part line P3 is formed above the part line P2, which is just above the lower first braid B1. Once the new row of braidable hair has been formed, the new row of hair and attachment strands are combed together. The adjacent weft attachment strands 24 are entrained into the braidable hair of the new row. The unfinished end of the braid B1 is braided into the new row, along with the next weft attachment strand 24 extending from the weft 18, to begin the next braid row B2. Braiding continues as described further above for the first braid row B1, with braiding of the second braid row B2 working in the opposite direction to the braiding of the first braid row B1.

Figure 11:
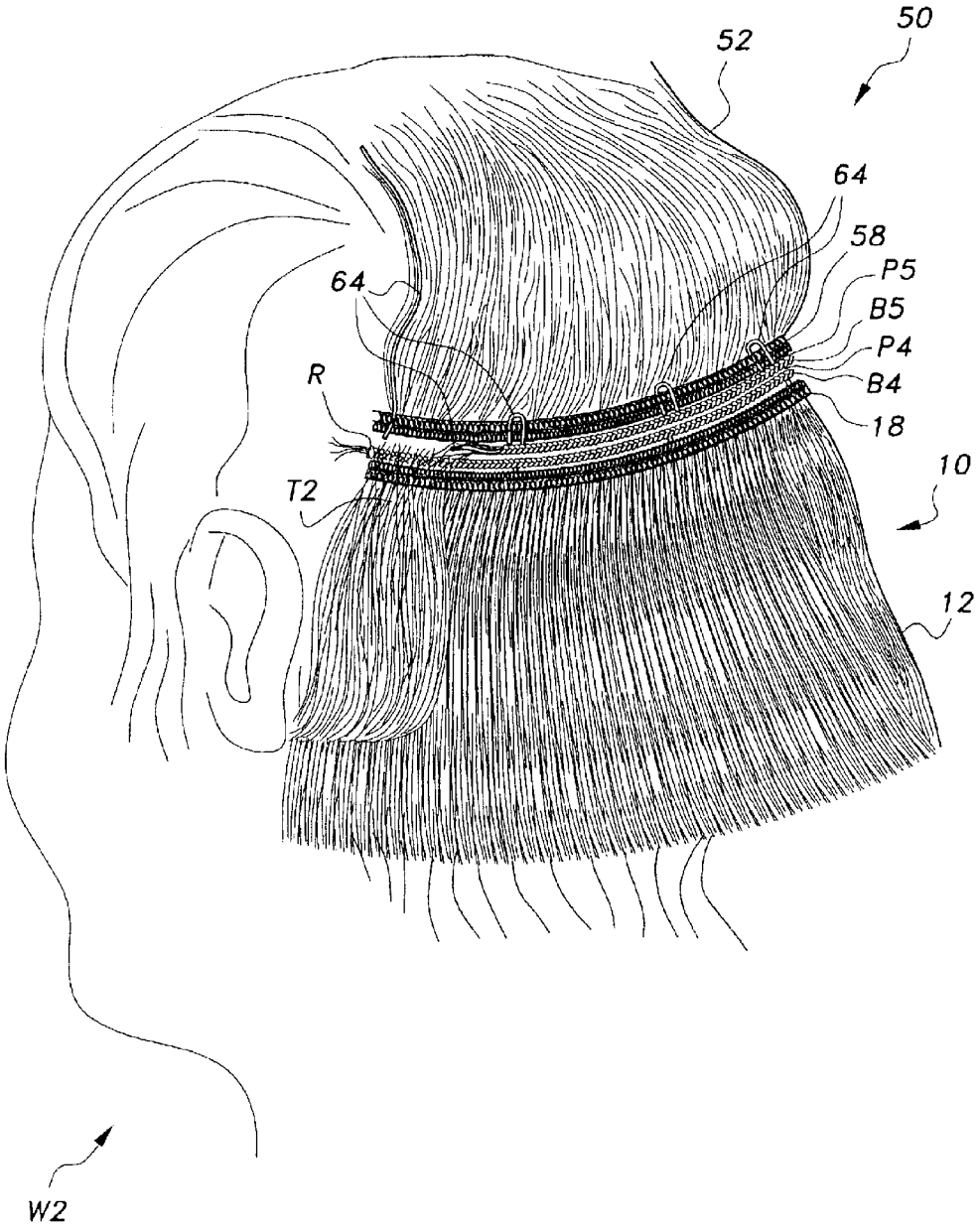
FIG. 11 is a rear perspective view of the wearer's head of FIG. 10, showing the second step in the finishing piece hair extension installation of the present invention.
Figure 12:
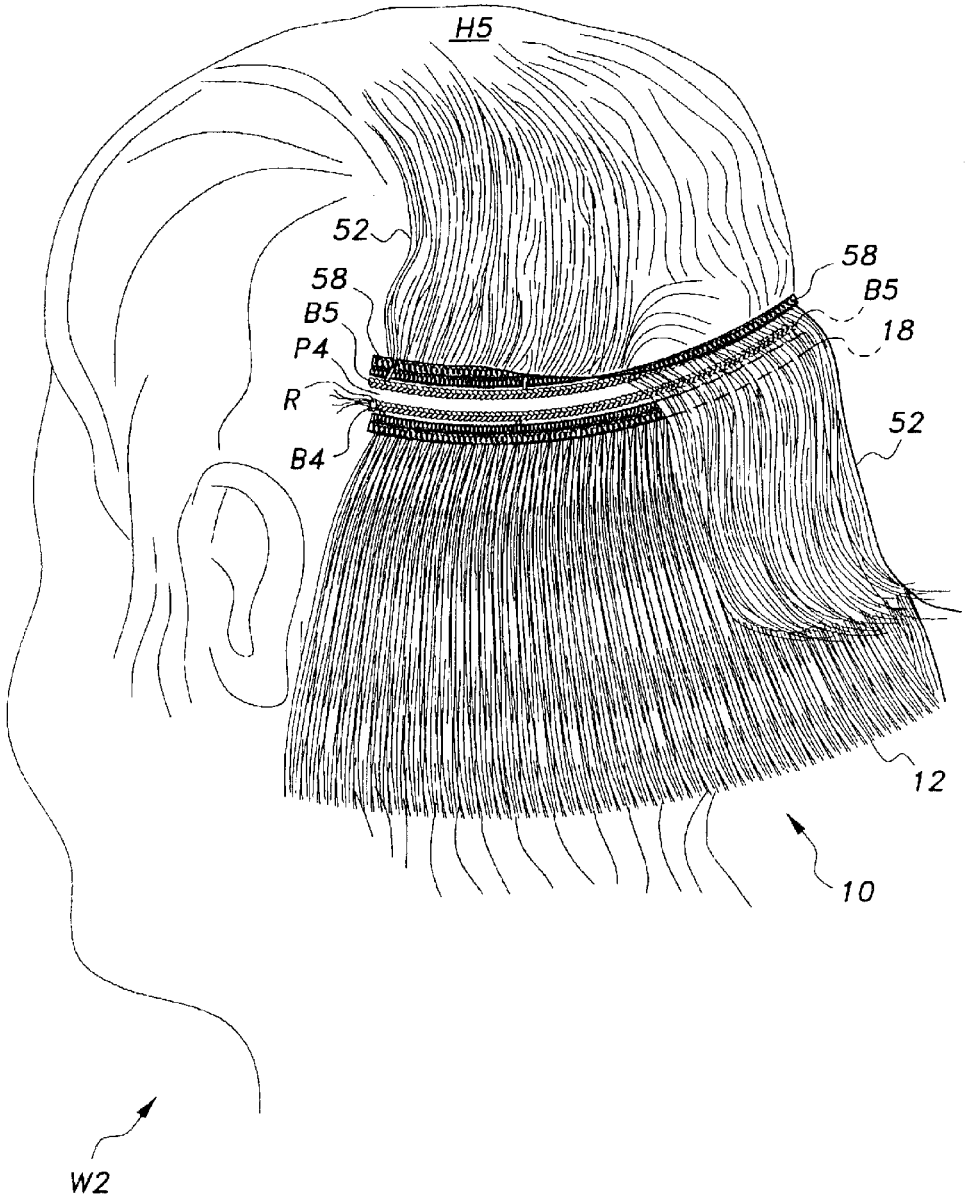
FIG. 12 is a rear perspective view of the wearer's head of FIGS. 10 and 11, showing the third step in the installation of the present finishing piece hair extension of FIG. 8.

It will be seen that the above described process may be continued to form as many braided rows as desired, with a corresponding number of hair extension weft rows secured thereto by means of the attachment strands braided integrally therewith. The completed braid rows, and hair extension weft rows, form a relatively wide sinusoidal pattern back and forth over the scalp of the wearer W1, generally as shown in the completed three row braid and weft pattern illustrated in FIG. 7 of the drawings. The end of the braid B3 may be secured with a small rubber band R or the like, as shown in FIGS. 11 and 12, to complete the operation and prevent the braid from unraveling. Depending upon the length of the native hair of wearer W1, the distal end of the native braid may extend several inches beyond the base of the braid. Any remaining braid end is tacked inwardly to lie flat into the part P5 between braid rows B4 and B5, as shown in FIG. 12, and the braid end is secured in place by a hair pin or the like.

Finally, the uppermost portion or area H3 of the native hair of the wearer W1 is combed or brushed back and downwardly over the single or multiple hair extension wefts or weft rows, to complete the operation. When wefts are chosen which closely match the color and texture of the wearer's native hair, or the wearer's hair is treated to match the wefts, the result is the appearance of a full and lush head of hair which is virtually undistinguishable from a full head of native hair of the wearer. The multiple weft overlay of the above process, provides an extremely full and dense hair extension, and serves to completely conceal the underlying braids and weft edges.

The above described process or operation is particularly suitable for creating the appearance of a full head of hair over the majority of the scalp or head, as desired. However, the construction of the base weft extensions used above, with their attachment strands extending opposite the hair which extends from the bound weft edge, result in the attachment braid being deployed somewhat above the weft. This may result in the attachment braid and/or weft edge not being completely concealed, depending upon the amount of native hair available for combing over the braid and weft edge. The above base extension configuration may not be particularly suitable for use along a hairline or along a part line where no adjacent weft is installed, due to the lack of hair available opposite the attachment braid for concealing the braid and weft edge.

Figure 8:
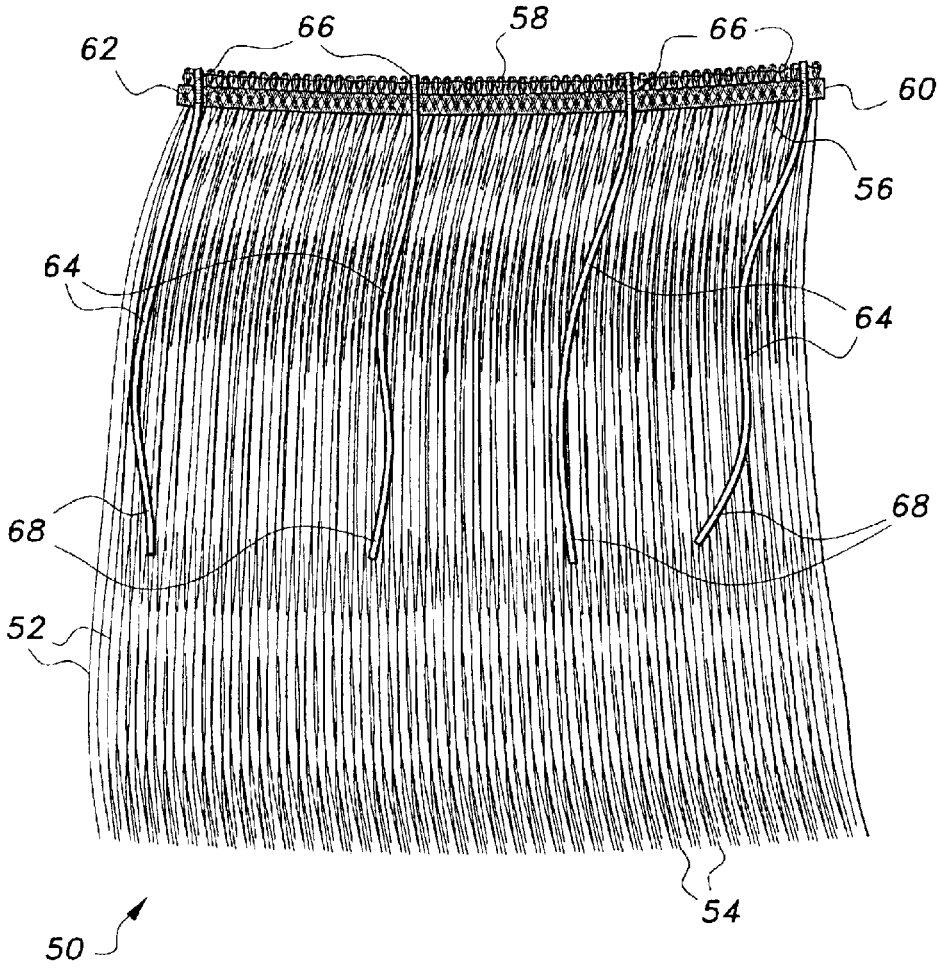
FIG. 8 is a rear perspective view of another embodiment of the present hair extension attachment, comprising a finishing piece having attachment strands extending from the weft edge in the same direction as the hair strands, for installation along a hairline or part line of the wearer.

Accordingly, another aspect of the present invention comprises a finishing extension piece, a first embodiment of which is illustrated in FIG. 8 and designated as wefted hair extension finishing piece 50. The finishing extension piece 50 of FIG. 8 has a configuration substantially the same as that of the base extension 10, illustrated in FIGS. 1 and 3 through 7, excepting the orientation of the attachment strands. The wefted hair extension 50 of FIG. 8 includes a large number of individual hair strands 52 having free ends 54 and opposite weft attachment ends 56. The weft attachment ends are bound together in a single, continuous weft edge 58, which spans the extension 50 from a first end 60 to an opposite second end 62. The hair strands 52 extend essentially unidirectionally from the bound weft edge 58, and generally form a somewhat planar sheath of hair.

The difference between the base weft extension embodiment of FIGS. 1 and 3 through 7 is strictly in the orientation of the attachment strands 64 extending therefrom. The attachment ends 66 of the attachment strands 64 are permanently secured (e.g., stitched, etc.) to the weft edge 58, just as in the base weft extension 10. However, the attachment strands 64 of the hair weft 50 of FIG. 8 are oriented to extend in the opposite direction from the attachment strands 24 of the weft 10, with the attachment strands 64 extending in the same direction from the weft edge 58 as the hair strands 52, and the main lengths and free ends 68 of the attachment strands 64 lying in the same general plane as the hair strands 52. This provides certain advantages in concealing the weft edge and more particularly the braid, when the hair weft extension embodiment 50 of FIG. 8 is used along a part line or hairline. This process is illustrated in FIGS. 10 through 13, and explained in detail further below. As in the case of the wefted hair extension 10 of FIGS. 1 and 3 through 7, the extension 50 of FIG. 8 is illustrated as a relatively short and narrow element. It will be understood that the hair strands 52 would normally have a significantly greater length, and the weft edge 58 would normally be supplied in a span of a few to several feet, to be cut or trimmed to length as desired. Preferably, natural human hair is used for forming the hair strands 52 of the hair weft 50 of FIG. 8, with the hair being straight, curled, kinky, or in any other pattern or form as desired. Such natural hair may retain its natural color, or may be dyed or otherwise treated as desired. Alternatively, the hair strands 52 may be formed of synthetic fibers, if so desired.

Figure 9:
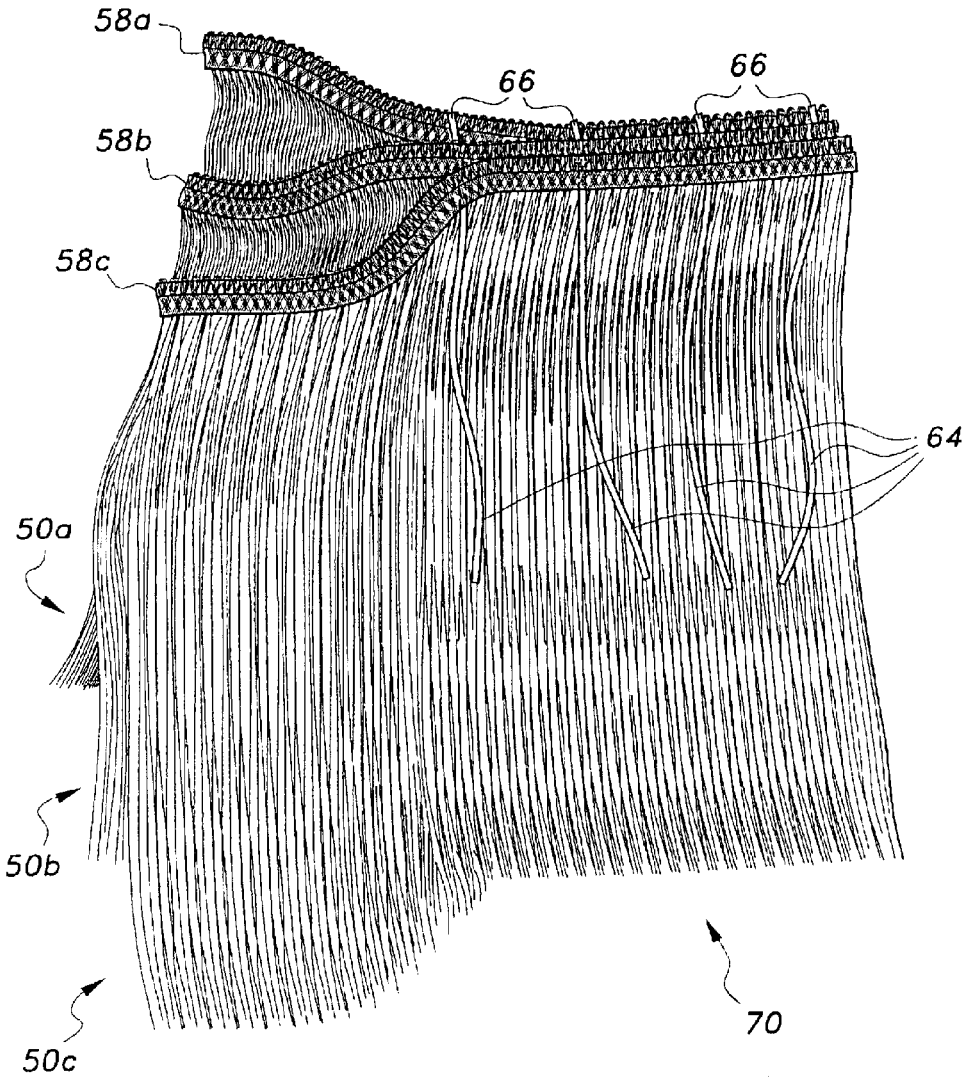
FIG. 9 is a rear elevation view of a partially constructed alternate embodiment of the wefted hair extension finishing piece of FIG. 8, illustrating the overlapping assembly of a plurality of hair wefts to form a fuller and more dense hair extension.

FIG. 9 illustrates an alternative embodiment of the wefted hair extension 50 of FIG. 8, in which a plurality of such extensions are sewn or otherwise permanently secured together along their wefted edges to form a multiple weft extension 70 having a fuller and more dense fall or extension of hair, in a manner similar to the multiple weft hair extension 30 of FIG. 2. In FIG. 9, a series of wefted extensions 50*a*, 50*b*, and 50*c*, each substantially identical to the extension 50 of FIG. 8, are assembled together to form the multiple weft extension 70, by sewing or stitching their respective wefts 58*a*, 58*b*, and 58*c* together along their entire lengths. (The multiple weft extension 70 illustrated in FIG. 9 is incomplete, with the final stitching of the wefts 58*a*, 58*b*, and 58*c* shown uncompleted at the second ends thereof, in order to show clearly the three distinct wefts employed in the manufacture of the multiple weft extension 70.) The wefts 58*a*, 58*b*, and 58*c* are secured together in the same manner as that used for the assembly of the multiple weft extension 30 of FIG. 2, i.e. in an overlapping configuration, with the upper edge of the weft 58*b* secured slightly below the upper edge of the weft 58*a*, and the upper edge of the weft 58*c* secured slightly below the upper edge of the weft 58*b*. The weft attachment ends 66 of the attachment strands 64 are preferably captured and secured at the point where the first and second wefts 58*a* and 58*b* are sewn together, i.e., as in the multiple weft embodiment 30 of FIG. 2. However, the attachment strands 64 extend from the wefts 58*a* through 58*c* in the same direction as the hair strands 52*a*, 52*b*, and 52*c*, similarly to the configuration of the single weft finishing extension 50 of FIG. 8.

Figure 10:
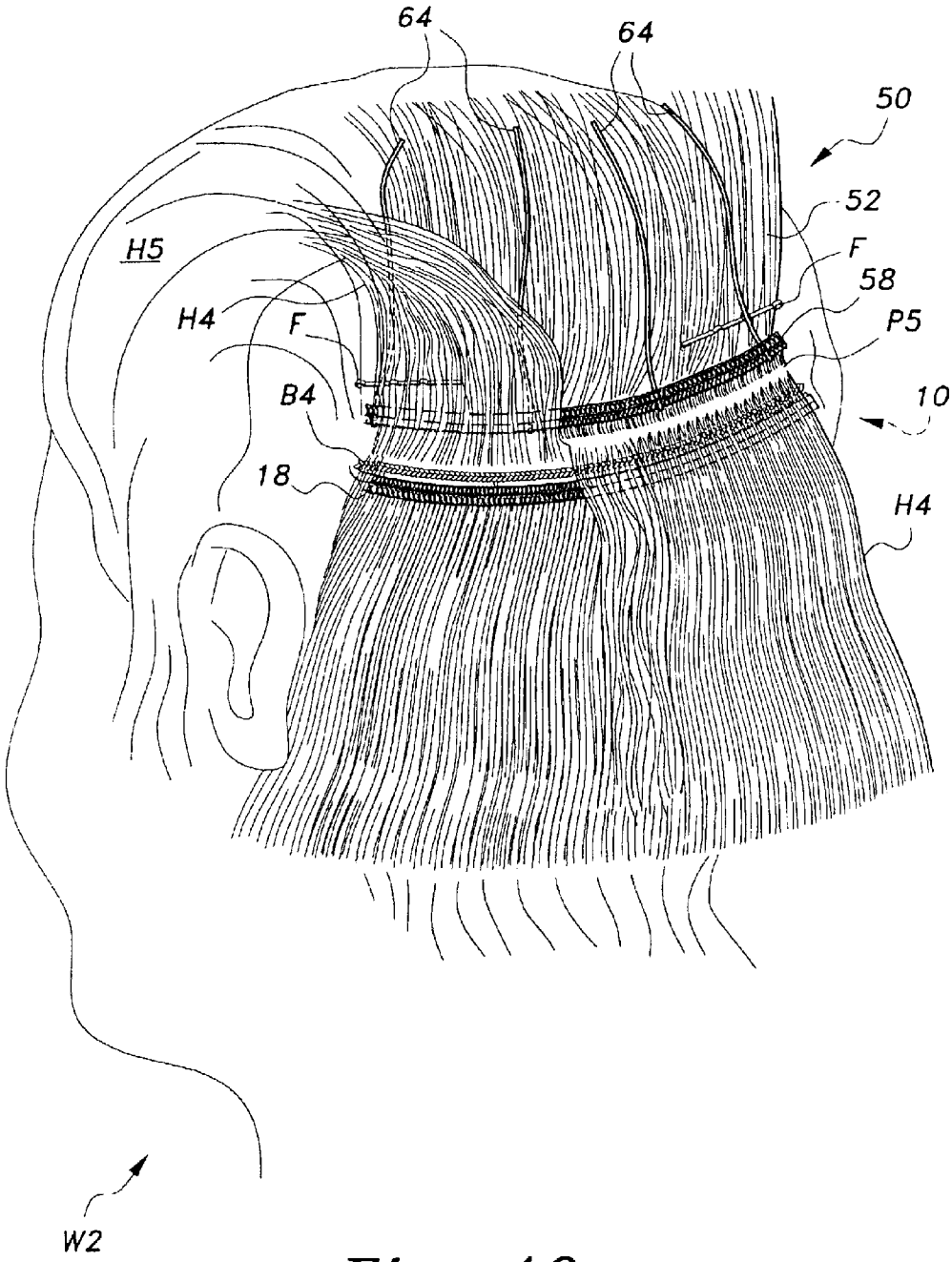
FIG. 10 is a rear perspective view of the head of a wearer of the present hair extension invention, showing a first step in the installation of the finishing piece hair extension of FIG. 8 to the native hair of the wearer.

The process by which the wefted hair finishing extensions are installed in the hair of a wearer is illustrated in FIGS. 10 through 13, and described in detail below. Initially, first and second part lines P4 and P5 are formed transversely across the head of a wearer W2 of the finishing hair extension 50, defining a transverse line or row of braidable native hair H4. (The lower part line P4 is concealed by the overlying and downwardly extending braidable hair row H4, in FIG. 10.) The hair 52 of the wefted hair finishing extension 50 is temporarily secured to the underlying, forwardly and upwardly combed hair H5 of the wearer W2 by means of bobby pins or other suitable fasteners F, as shown in FIG. 10. The hair 52 of the finishing piece 50, as well as the attachment strands 64, thus extend upwardly and forwardly over the native hair H5 of the wearer W2 in FIG. 10, with the part line P5 separating the weft edge 58 of the extension 50 from the row of braidable hair H4 extending downwardly below the part line P5.

At this point, a braiding pattern is initiated in the row of hair H4 between the two part lines P4 and P5, generally as shown in FIG. 11 of the drawings. The wefted hair extension attachment strands 64 which have been pulled down and entrained in the braidable hair H4, are braided integrally with the hair H4 during this step in the process. In FIG. 11, the braiding process has been started from the first end of the hair extension 50, to the right side of FIG. 11, working from right to left across the head of the wearer W2 to form the beginning of a finishing piece braid row B5. As in the case of the installation of the base piece hair extension 10 shown in FIGS. 3 through 7, the initiation of the braiding sequence from the right side is not required, and any braiding pattern may be used as desired, depending upon the orientation of the part lines formed in the hair of the wearer. The braiding is accomplished by dividing the strands of hair H4 between the two part lines P4 and P5 into three sections to form multiple fingers T2 of the wearer's native hair, and then braiding these fingers T2 together, along with the wefted extension attachment strands 64 as they are encountered with their entrainment in the braiding hair H4 of the wearer. As noted in the description of the installation of the base weft piece 10 further above, a French or other type of braid may be used as desired, with the braiding lying immediately adjacent the scalp of the wearer.

It will be noted in FIG. 11, that since the attachment strands 64 of the finishing piece hair extension 50 extend in a generally upwardly direction, in the same direction as the hair strands 52 extending therefrom, that the braiding of these strands 64 into the fingers of native hair formed from the hair row H4 disposed below the weft edge 58 of the finishing piece 50, will draw the strands 64 downwardly over and across the weft edge 58 as the braid B5 is formed. This is shown by the first three strands 64 extending between the weft edge 58 and the completed portion of the braid B5 to the right side of FIG. 11. The tension on the attachment strands 64 will tend to pull or roll the weft edge 58 over to a certain extent, thereby lifting the attachment ends of the hair strands 52 somewhat away from the head of the wearer W2, somewhat as illustrated in FIG. 11.

When the braid B5 (and others) has been completed, the otherwise free end is secured by some means, e.g., by wrapping tightly with a small rubber band R or the like, as shown in FIGS. 11 and 12 for the earlier completed braid B4 to which the base extension piece 10 has been secured. At this point, the newly secured weft edge 58 extends along and above the newly completed braid B5. However, it is desired that the hair weft strands 52 extend downwardly and rearwardly (in the illustrated example), and merely combing or brushing them over, would result in the hair weft strands initially extending upwardly before folding back downwardly over the head of the wearer W2. A much more natural disposition of the wefted hair strands 52 is achieved by rolling or folding the weft edge 58 of the finishing hair extension 50, over the top of the newly completed braid B5. This also has the advantage of concealing the braid B5 beneath the weft edge 58 of the finishing extension 50, as is the purpose of the finishing extension piece 50. This step is shown in its partially completed phase in FIG. 12 of the drawings, with the right side of the weft edge span 58 having been rolled or folded to lie flat over the top of the underlying braid B5, with the corresponding hair weft portion extending naturally downwardly over the underlying wefted hair 12 of the previously installed base extension piece 10. The opposite, left portion of the weft edge span 58 is shown in essentially the same orientation as shown in the previous FIG. 11, to clearly show the difference in orientation of the two weft edge span 58 end portions and the process of rolling or folding the weft edge 58 over the top of the associated braid B5.

As in the case of the installation of the base hair extension pieces 10 (or 30) described further above, the process for the installation of the finishing pieces 50 (or 70) may be continued to form as many braided rows as desired, with a corresponding number of hair extension weft rows secured thereto by means of the attachment strands braided integrally therewith. The completed braid rows, and hair extension weft rows, may form a relatively wide sinusoidal pattern back and forth over the scalp of the wearer W1, or may alternatively be installed as a series of separate wefted hair extension pieces in separate rows, if so desired.

Figure 13:
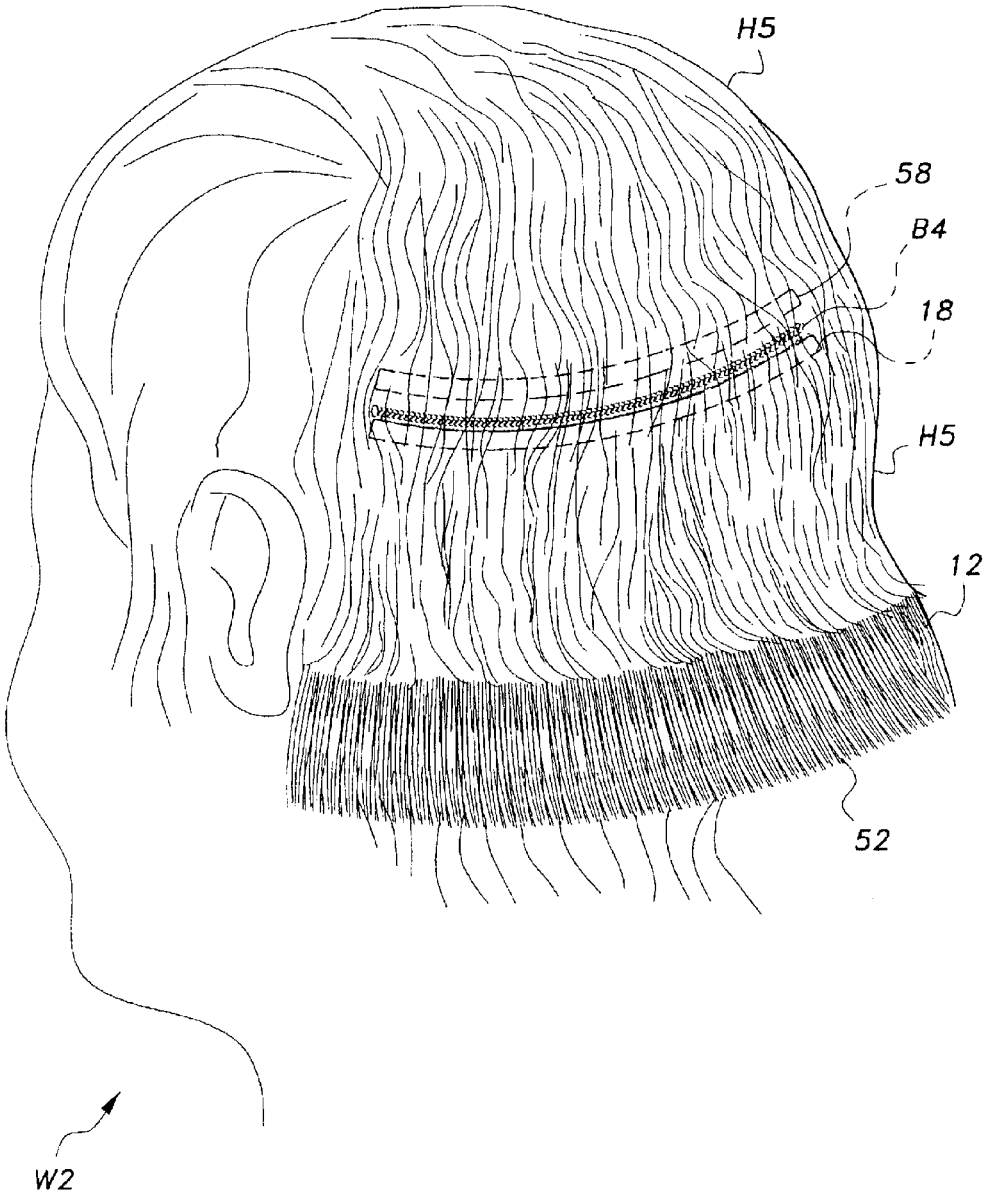
FIG. 13 is a rear perspective view of the wearer's head of FIGS. 10 through 12, illustrating the final step in the installation of the present finishing piece hair extension, the wearer's native hair combed over the completed hair extension installation.

FIG. 13 depicts the end result of the above described hair extensions and integral attachment strands, and methods of installation. In FIG. 13, the weft edge 58 of the finishing weft extension 50 has been completely folded over to completely conceal the underlying braid B5 (not shown in FIG. 13). The base piece 10 installed immediately below the finishing piece 50, extends below its respective attachment braid B4. The weft edges 18 and 58 of the two hair extensions 10 and 50, as well as the attachment braid B4 for the base extension 10, are concealed by combing or brushing the native hair H5 of the wearer W2 over the weft edges and braids, generally as shown in FIG. 13.

Figure 14:
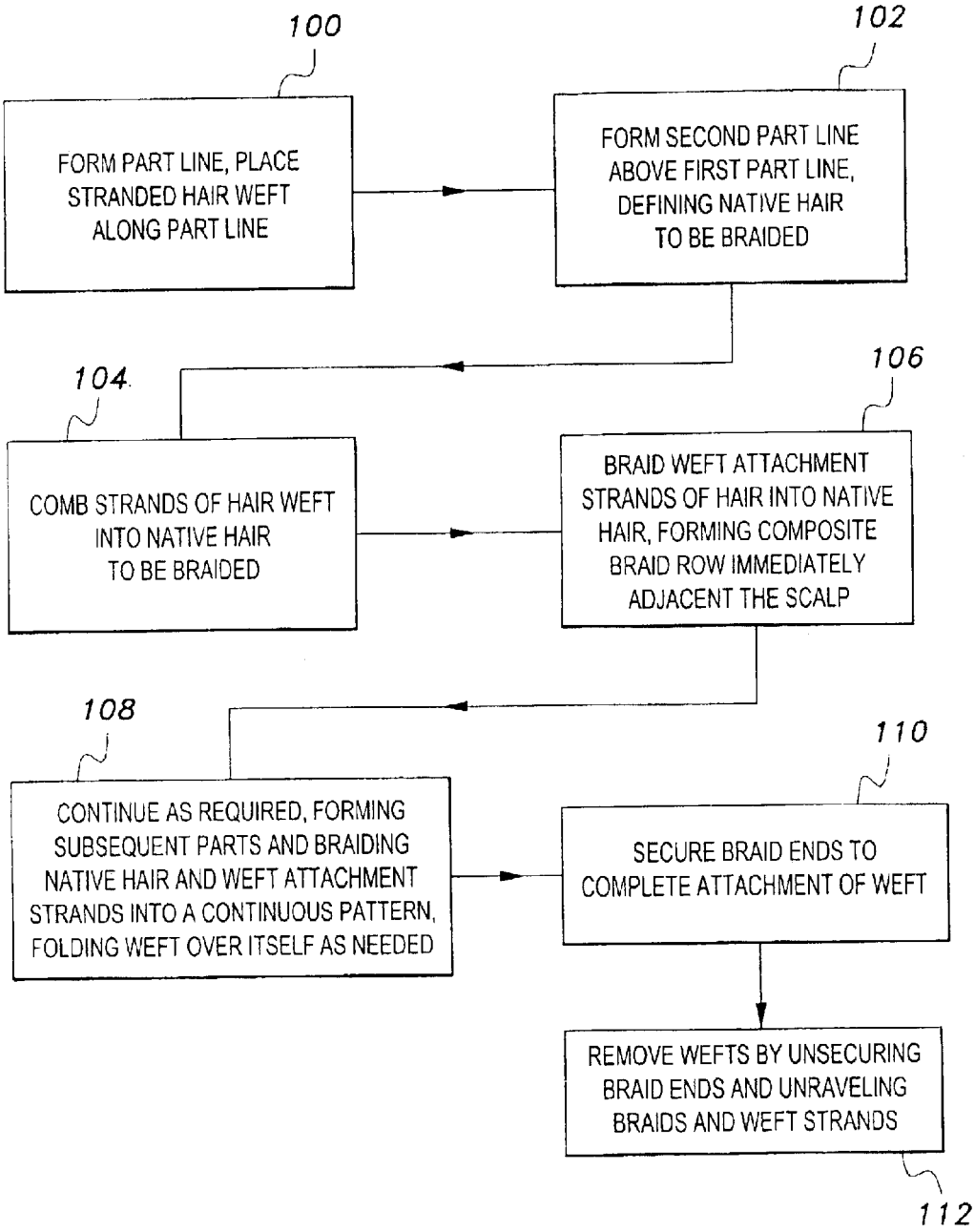
FIG. 14 is a flow chart which briefly describes the basic steps in the method of installation and removal of the present hair extension attachments.

FIG. 14 provides a flow chart briefly summarizing the steps in the method of installation and removal of the present wefted hair extensions and their attachment strands. All of the methods of installing the various embodiments of the present wefted hair extensions begin by forming a part line along the location of the wearer's head where the hair extension is to be installed, and temporarily securing the hair extension to the native hair adjacent the part line, generally as indicated in the first step 100 of FIG. 14. After this has been accomplished, a second part line is formed slightly removed from the first part line, with the two generally parallel part lines defining a row of the wearer's native hair to be braided, generally as indicated in the second step 102 of FIG. 14.

At this point, the attachment strands extending from the weft edge of the hair extension piece are combed into the native hair to be braided, as indicated by the third step 104 of FIG. 14. The native hair along the row between the part lines is progressively braided from one end to the other, with the hair weft attachment strands braided into the wearer's native hair during the braiding operation to produce a composite braid row comprising the wearer's native hair and the weft attachment strands, generally as indicated by the fourth step 106 of FIG. 14. This process is continued as desired, with subsequent parts being formed in the wearer's hair and braiding the native hair and weft attachment strands continuing until the desired result is achieved, generally as indicated in the fifth step 108 of FIG. 14. Alternatively, a series of separate braids and hair weft extensions may be installed to overlap one another, if so desired.

Once the braiding and weft strand attachment operation has been completed, the free end of the braid is secured to prevent unraveling, generally as indicated by the sixth step 110 of FIG. 14. The result is an attractive hairstyle of full bodied hair which is very difficult to tell from the wearer's natural hair, when the present attachment procedure is performed by a skilled practitioner. The present hair extensions and integral attachment strands, and methods of attachment to the wearer's native hair, allow the extensions to be secured in place to the wearer's native hair simultaneously with the braiding operation, thus saving time otherwise required in a subsequent operation to attach the hair wefts after the native hair has been braided. An additional advantage of the present hair weft attachments is that the attachment of the wefts to the wearer's native hair is as secure as the more time consuming sewing methods, and more substantially secure than the adhesive or mechanical hair attachment methods. The present hair extensions and attachment methods allow the supplemental wefted hair to be worn for up to several weeks at a time, with only normal care (shampooing, brushing, etc.) being required, just as in the case of the wearer's native hair. The wearer of the present hair extensions can swim, change hair styles, wash and otherwise care for their hair, and in general treat their supplemental hair extensions in the same manner as they would their native hair, yet the installation is quite cost effective, due to the labor savings involved.

When the wearer desires to remove or replace the wefted hair extensions of the present invention, it is only necessary to remove the small band or other component securing the distal end of the braid(s), and unravel the braid(s). The attachment strands of the hair extensions will automatically separate from the braided strands or fingers of the wearer's native hair, as the braid(s) become(s) unraveled. This operation may be quickly and easily accomplished by the wearer of the present hair extensions without need for additional professional care or assistance, as is required where hair extensions are sewn or otherwise mechanically or adhesively fastened to the wearer's native hair. Removal of the present hair extensions requires only on the order of thirty minutes or so to accomplish, thus resulting in a relatively minor expenditure even if the wearer decides to have a professional remove the hair extensions.

Accordingly, the present hair extension attachments and attachment methods will provide the wearer with considerably more freedom in the care and treatment of their supplemental hair, as well as considerably more options for changing styles as desired. The economy provided by the present hair extensions and attachment methods, as well as the security and longevity of installation, enable the wearer to visit a hair professional more regularly than might be the case with more time and labor intensive supplemental hair procedures, thus allowing the wearer the option of economizing through the time and labor saved, or enjoying greater freedom to change hairstyles more frequently if so desired. Whatever the desires of the wearer, the present hair extension attachments will be greatly appreciated by anyone who has occasion to install supplemental hair extensions in their native hair, whatever the reason may be.

It is to be understood that the present invention is not limited to the embodiments described above, but encompasses any and all embodiments within the scope of the following claims.

I claim:

1. A hair extension attachment, comprising:

a wefted hair extension having a width and a bound weft edge extending along the width with a plurality of hair strands extending substantially unidirectionally therefrom; and at least three flexible attachment strands extending along the width of said hair extension, one of said attachment strands being on each end of the hair extension, at least one of said strands being between the two attachment strands, each if said three flexible attachment strands having a first end and a second free end, each said first end being attached to said weft edge and each said second free end extending from the weft edge of said hair extension for braiding directly with a portion of native hair of a wearer.

2. The hair extension attachment according to claim 1, wherein said attachment strands are substantially coplanar with and extend from the weft edge in a direction opposite said hair strands.

3. The hair extension attachment according to claim 1, wherein said attachment strands are substantially coplanar with and extend from the weft edge in a direction identical to said hair strands.

4. The hair extension attachment according to claim 1, wherein the bound weft edge of said wefted hair extension comprises a single weft.

5. The hair extension attachment according to claim 1, wherein:

the bound weft edge of said wefted hair extension comprises a plurality of wefts overlappingly secured together; and said attachment strands are secured between adjacent wefts of said plurality of wefts.

6. The hair extension attachment according to claim 1, wherein:

said attachment strands are selected from the group consisting of elastic and inelastic strands; and said hair strands are selected from the group consisting of natural and synthetic fibers.

7. A method of attaching a wefted hair extension to the native hair of a wearer using the apparatus of claim 1, comprising the steps of:

(a) parting the native hair of the wearer, and defining a first part line therein;

(b) securing the wefted hair extension to the native hair of the wearer, adjacent the part line;

(c) parting the native hair of the wearer adjacent the first part line, and defining a second part line generally parallel to the first part line and separated therefrom by a braidable section of native hair;

(d) combing the attachment strands of the hair extension into the braidable section of native hair of the wearer; and (e) braiding the braidable section of native hair of the wearer in an elongate braid adjacent the scalp of the wearer, simultaneously capturing and braiding the attachment strands of the hair extension integrally therewith.

8. The method of attaching a wefted hair extension to the native hair of a wearer according to the method of claim 7, further including the step of securing the end of the braid as it is completed, preventing the completed braid from unraveling.

9. The method of attaching a wefted hair extension to the native hair of a wearer according to the method of claim 7, wherein the step of braiding the braidable section of native hair of the wearer is selected from the steps consisting of forming at least one French braid, forming at least one corn row braid, and forming a braid using other braiding techniques.

10. The method of attaching a wefted hair extension to the native hair of a wearer according to the method of claim 7, wherein the step of braiding the braidable section of native hair of the wearer comprises forming a sinusoidal braid pattern.

11. The method of attaching a wefted hair extension to the native hair of a wearer according to the method of claim 7, further including the step of constructing the hair extension as a base piece by installing the plurality of flexible attachment strands extending from the weft edge of the hair extension substantially coplanar with and extending from the weft edge in a direction opposite the hair strands.

12. The method of attaching a wefted hair extension to the native hair of a wearer according to the method of claim 7, further including the step of constructing the hair extension as a finishing piece by installing the plurality of flexible attachment strands extending from the weft edge of the hair extension substantially coplanar with and extending from the weft edge in a direction the same as that of the hair strands.

13. The method of attaching a wefted hair extension to the native hair of a wearer according to the method of claim 7, further including the step of removing the hair extension from the native hair of the wearer by unraveling the braid and separating the attachment strands of the hair extension from the unbraided native hair of the wearer.

14. A method of attaching a wefted hair extension to the native hair of a wearer, comprising the steps of:

(a) providing a wefted hair extension having a bound weft edge with a plurality of hair strands extending substantially unidirectionally therefrom;

(b) installing a plurality of flexible attachment strands extending from the weft edge of the hair extension;

(c) parting the native hair of the wearer, and defining a first part line therein;

(d) securing the wefted hair extension to the native hair of the wearer, adjacent the part line;

(e) parting the native hair of the wearer adjacent the first part line, and defining a second part line generally parallel to the first part line and separated therefrom by a braidable section of native hair;

(f) combing the attachment strands of the hair extension into the braidable section of native hair of the wearer; and (g) braiding the braidable section of native hair of the wearer in an elongate braid adjacent the scalp of the wearer, simultaneously capturing and braiding the attachment strands of the hair extension integrally therewith.

15. The method of attaching a wefted hair extension to the native hair of a wearer according to the method of claim 14, further including the step of securing the end of the braid as it is completed, preventing the completed braid from unraveling.

16. The method of attaching a wefted hair extension to the native hair of a wearer according to the method of claim 14, wherein the step of braiding the braidable section of native hair of the wearer is selected from the steps consisting of forming at least one French braid, forming at least one corn row braid, and forming a braid using other braiding techniques.

17. The method of attaching a wefted hair extension to the native hair of a wearer according to the method of claim 14, wherein the step of braiding the braidable section of native hair of the wearer comprises forming a sinusoidal braid pattern.

18. The method of attaching a wefted hair extension to the native hair of a wearer according to the method of claim 14, wherein the step of installing a plurality of flexible attachment strands extending from the weft edge of the hair extension comprises forming a base piece by installing the flexible attachment strands substantially coplanar with and extending from the weft edge in a direction opposite the hair strands.

19. The method of attaching a wefted hair extension to the native hair of a wearer according to the method of claim 14, wherein the step of installing a plurality of flexible attachment strands extending from the weft edge of the hair extension comprises forming a finishing piece by installing the flexible attachment strands substantially coplanar with and extending from the weft edge in a direction the same as that of the hair strands.

20. The method of attaching a wefted hair extension to the native hair of a wearer according to the method of claim 14, further including the step of removing the hair extension from the native hair of the wearer by unraveling the braid and separating the attachment strands of the hair extension from the unbraided native hair of the wearer.

* * * * *